US008625808B2

(12) United States Patent
Kim et al.

(10) Patent No.: US 8,625,808 B2
(45) Date of Patent: Jan. 7, 2014

(54) METHODS AND APPARATUSES FOR ENCODING AND DECODING OBJECT-BASED AUDIO SIGNALS

(75) Inventors: Dong Soo Kim, Seoul (KR); Hee Suk Pang, Seoul (KR); Jae Hyun Lim, Seoul (KR); Sung Yong Yoon, Seoul (KR); Hyun Kook Lee, Seoul (KR)

(73) Assignee: LG Elecronics Inc., Seoul (KR)

( * ) Notice: Subject to any disclaimer, the term of this patent is extended or adjusted under 35 U.S.C. 154(b) by 1425 days.

(21) Appl. No.: 11/865,632

(22) Filed: Oct. 1, 2007

(65) Prior Publication Data

US 2009/0164221 A1 Jun. 25, 2009

Related U.S. Application Data

(60) Provisional application No. 60/848,293, filed on Sep. 29, 2006, provisional application No. 60/829,800, filed on Oct. 17, 2006, provisional application No. 60/863,303, filed on Oct. 27, 2006, provisional application No. 60/860,823, filed on Nov. 24, 2006, provisional application No. 60/880,714, filed on Jan. 17, 2007, provisional application No. 60/880,942, filed on Jan. 18, 2007, provisional application No. 60/948,373, filed on Jul. 6, 2007.

(51) Int. Cl.
*H04R 5/00* (2006.01)

(52) U.S. Cl.
USPC ..... 381/1; 381/22

(58) Field of Classification Search
USPC ..... 381/1, 17, 22; 700/94; 704/500, 501, 704/502, 503, 504
See application file for complete search history.

(56) References Cited

U.S. PATENT DOCUMENTS

| | | | | |
|---|---|---|---|---|
| 3,882,280 | A | 5/1975 | Goutmann | |
| 5,583,962 | A | 12/1996 | Davis et al. | |
| 6,849,794 | B1 | 2/2005 | Lau et al. | |
| 7,006,636 | B2 | 2/2006 | Baumgarte et al. | |
| 7,116,787 | B2 * | 10/2006 | Faller | 381/17 |
| 2003/0026441 | A1 | 2/2003 | Faller | |

(Continued)

FOREIGN PATENT DOCUMENTS

| | | |
|---|---|---|
| CA | 2 597 746 | 8/2006 |
| CN | 1503572 | 6/2004 |

(Continued)

OTHER PUBLICATIONS

Office Action, Canadian Appln. No. 2 645 909, dated Dec. 29, 2010, 3 pages.

(Continued)

*Primary Examiner* — Duc Nguyen
*Assistant Examiner* — Kile Blair
(74) *Attorney, Agent, or Firm* — Fish & Richardson P.C.

(57) ABSTRACT

Provided are an audio encoding method and apparatus and an audio decoding method and apparatus in which audio signals can be encoded or decoded so that sound images can be localized at any desired position for each object audio signal. The audio decoding method includes extracting a downmix signal and object-based side information from an audio signal; generating channel-based side information based on object-based side information and control information for rendering the downmix signal; processing the downmix signal using a decorrelated channel signal; and generating a multi-channel audio signal using the processed downmix signal and the channel-based side information.

10 Claims, 17 Drawing Sheets

(56) References Cited

U.S. PATENT DOCUMENTS

| | | | |
|---|---|---|---|
| 2003/0167173 | A1 | 9/2003 | Levy et al. |
| 2003/0187663 | A1 | 10/2003 | Truman et al. |
| 2003/0236583 | A1 | 12/2003 | Baumgarte et al. |
| 2005/0120870 | A1 | 6/2005 | Ludwig |
| 2005/0157883 | A1 | 7/2005 | Herre et al. |
| 2005/0180579 | A1 | 8/2005 | Baumgarte et al. |
| 2006/0016735 | A1 | 1/2006 | Ito et al. |
| 2006/0085200 | A1 | 4/2006 | Allamanche et al. |
| 2007/0236858 | A1 | 10/2007 | Disch et al. |
| 2007/0291951 | A1 | 12/2007 | Faller |
| 2008/0130904 | A1 | 6/2008 | Faller |
| 2008/0167880 | A1 | 7/2008 | Seo et al. |
| 2009/0028360 | A1 | 1/2009 | Griesinger |
| 2009/0043591 | A1 | 2/2009 | Breebaart et al. |
| 2009/0067634 | A1 | 3/2009 | Oh et al. |
| 2009/0129601 | A1 | 5/2009 | Ojala et al. |

FOREIGN PATENT DOCUMENTS

| | | |
|---|---|---|
| CN | 1783728 | 6/2006 |
| EP | 0 857 375 | 8/1998 |
| EP | 1 278 184 | 1/2003 |
| EP | 1691348 | 8/2006 |
| EP | 2 038 878 | 1/2008 |
| IT | TO950869 | 4/1997 |
| JP | 2000-156038 | 6/2000 |
| JP | 2001-028800 | 1/2001 |
| JP | 2003-186500 | 7/2003 |
| JP | 2004-064363 | 2/2004 |
| JP | 2006-517356 | 7/2006 |
| JP | 2008-522244 | 6/2008 |
| JP | 2008-537833 | 9/2008 |
| JP | 2009-518725 | 5/2009 |
| JP | 2009-527954 | 7/2009 |
| RU | 2121718 | 11/1998 |
| RU | 2002126217 | 4/2004 |
| RU | 2004133032 | 4/2005 |
| RU | 2005104123 | 7/2005 |
| RU | 2005135648 | 3/2006 |
| WO | 97/15983 | 5/1997 |
| WO | 03/090208 | 10/2003 |
| WO | 2003/090208 | 10/2003 |
| WO | 2005/101370 | 10/2005 |
| WO | WO 2006-003891 | 1/2006 |
| WO | 2006/016735 | 2/2006 |
| WO | 2006/048203 | 5/2006 |
| WO | 2006/060279 | 6/2006 |
| WO | 2006/089685 | 8/2006 |
| WO | WO 2006-089570 | 8/2006 |
| WO | 2007/004828 | 1/2007 |
| WO | 2007/004830 | 1/2007 |
| WO | 2007/089131 | 8/2007 |

OTHER PUBLICATIONS

"Call for Proposals on Spatial Audio Object Coding." ITU Study Group 16—Video Coding Experts Group—ISO/IEC MPEG & ITU-T VGEG(ISO/IEC JTC1/SC29/WG11 & ITU-T SG16 Q6) No. N8853, Feb. 19, 2007, 18 pages.

"Draft Call for Proposals on Spatial Audio Object Coding," ITU Study Group 16—Video Coding Experts Group—ISO/IEC MPEG & ITU-T VGEG(ISO/IEC JTC1/SC29/WG11 and ITU-T SG16 Q6) No. N8639, Oct. 27, 2006, 16 pages.

Summons to Attend Oral Proceedings, European Appln. No. 07833115.4, dated Apr. 6, 2011, 5 pages.

"Concepts of Object-Oriented Spatial Audio Coding", (Jul. 21, 2006), 8 pages.

Supp. European Search Report for Application No. EP 07 83 3115, dated Jul. 24, 2009, 5 pages.

Supp. European Search Report for Application No. EP 07 83 3116, dated Jul. 28, 2009, 6 pages.

Faller, C. and Baumgarte, F., (2003) Binaural Cue Coding—Part II: Schemes and Applications, IEEE Transactions on Speech and Audio Processing, 11(6):520-531.

Herre, J. and Disch, S., (2007) "New Concepts in Parametric Coding of Spatial Audio: From Sac to Saoc", IEEE pp. 1894-1897.

Villemoes et al., (2006) "MPEG Surround: The Forthcoming ISO Standard for Spatial Audio Coding", Proceedings of the International AES Conference pp. 1-18.

Office Action, U.S. Appl. No. 11/865,671, mailed Aug. 27, 2010, 16 pages.

Notice of Allowance, Russian Appln. No. 2009116275, mailed Aug. 5, 2010, 6 pages.

Notice of Allowance, Russian Appln. No. 2009116279, mailed Aug. 5, 2010, 6 pages.

Office Action, U.S. Appl. No. 11/865,663, dated Nov. 8, 2010, 5 pages.

Baumgarte, et al., "Binaural Cue Coding—Part I: Psychoacoustic Fundamentals and Design Principles", IEEE Transactions on Speech and Audio processing, vol. 11, No. 6, Nov. 2003, pp. 509-519.

Office Action, U.S. Appl. No. 11/865,679, dated Oct. 27, 2010, 13 pages.

Faller et al., "Efficient Representation of Spatial Audio Using Parameterization", IEEE Workshop on the Applications of Signal Processing to Audio and Acoustics, Oct. 20-24, 2001, pp. W2001-1-W2001-4.

Office Action, Japanese Appln. No. 2009-530280, dated Sep. 27, 2010, 10 pages with English translation.

Supplementary European Search Report, dated Oct. 19, 2009, corresponding to European Application No. EP 07834266.4, 7 pages.

Herre J et al: "The Reference Model Architecture, for Mpeg Spatial Audio Coding" Audio Engineering Society Convention Paper, New York, NY, US May 28, 2005, pp. 1-13, XP009059973.

Joint Video Team: "Concepts of Object-Oriented Spatial Audio Coding" Joint Video Team (JVT) of ISO/IEC MPEG & ITU-T VCEG (ISO/IEC JTC1/SC29/WG11 and ITU-T SG16 Q6), No. N8329, Jul. 21, 2006, XP030014821.

Engdegard J et al: "Spatial Audio Object Coding (SAOC)—The Upcoming MPEG Standard on Parametric Object Based Audio Coding" 124th AES Convention, Audio Engineering Society, Paper 7377, May 17, 2008 ~ May 20, 2008, pp. 1-15, XP002541458.

Summons to Attend Oral Proceedings, European Appln. No. 07833112.1, dated May 30, 2011, 6 pages.

Notice of Allowance, Russian Application No. 2009116256, mailed Jun. 16, 2010, 6 pages.

Faller, "Parametric Joint-Coding of Audio Sources," *Audio Engineering Society 120 Convention*, May 20-23, 2006, 12 pages.

Scheirer et al., "AudioBIFS: The MPEG-4 Standard for Effects Processing," *Workshop on Digital Audio Effects Processing* (*DAFX'98*), Nov. 1992, 9 pages.

Office Action from Korean Application No. 10-2008-7026605, dated Jul. 30, 2010, 9 pages (English language translation included).

Faller, "Parametric Coding of Spatial Audio Effects," Oct. 5, 2004, Chapter 5.4, pp. 84-90.

Notice of Allowance, Russian Appln. No. 2010141971, dated Jan. 16, 2012, 14 pages with English translation.

Engdegård et al., "CT/Fraunhofer IIS/Philips Submission to the SAOC CfP," 1. AVC Meeting, Nov. 13, 1990-Nov. 16, 1990, The Hague, (CCITT SGXVExpert Group for ATM Video Coding), No. M14696, Jun. 27, 2007, 13 pages.

Oral Proceedings Communication, European Appln. No. 07833118.8, dated Oct. 17, 2011, 31 pages.

Herre et al., "Thoughts on an SAOC Architecture," ITU Study Group 16—Video Coding Experts Group—ISO/IEC MPEG & ITU-T VCEG (ISO/IEC JTC1/SC29/WG11 and ITU-T SG16 Q6), No. M13935, Oct. 18, 2006, 9 pages.

Office Action, Canadian Appln. No. 2,645,910, dated May 23, 2012, 3 pages.

Notice of Allowance in Russian Application No. 2010140328, dated Dec. 4, 2012, 16 pages.

US Office Action in U.S. Appl. No. 13/022,585, dated Jun. 18, 2013, 7 pages.

International Search Report, PCT Appln. No. PCT/KR2007/004800, Jan. 16, 2008, 3 pages.

International Search Report, PCT Appln. No. PCT/KR2007/004801, Jan. 28, 2008, 3 pages.

(56) References Cited

OTHER PUBLICATIONS

International Search Report, PCT Appln. No. PCT/KR2007/004803, Jan. 25, 2008, 3 pages.
International Search Report, PCT Appln. No. PCT/KR2007/005969, Mar. 31, 2008, 3 pages.
International Search Report, PCT Appln. No. PCT/KR2008/000883, Jun. 18, 2008, 6 pages.
Breebaart, J. et al., "MPEG Spatial Audio Coding/MPEG Surround: Overview and Current Status", Audio Engineering Society Convention Paper, Oct. 2005, New York, 17 pages.
Breebaart, J. et al., "Multi-Channel Goes Mobile: MPEG Surround Binaural Rendering", AES 29$^{th}$ International Conference, Sep. 2006, 13 pages.
Faller, C., "Coding of Spatial Audio Compatible with Different Playback Formats", Audio Engineering Society Convention Paper, 117$^{th}$ Convention, Oct. 2004, SF, 12 pages.
International Search Report based on International Application No. PCT/KR2007/004800, dated Jan. 16, 2008, 3 pages.
International Search Report based on International Application No. PCT/KR2007/004803, dated Jan. 25, 2008, 3 pages.
International Search Report based on International Application No. PCT/KR2007/004801, dated Jan. 28, 2008, 3 pages.
International Search Report based on International Application No. PCT/KR2007/005969, dated Mar. 31, 2008, 3 pages.
International Search Report based on International Application No. PCT/KR2008/000883, dated Jun. 18, 2008, 6 pages.
Moon, H. et al., "A Multi-Channel Audio Compression Method with Virtual Source Location Information for MPEG-4 SAC", IEEE Transactions on Consumer Electronics, 2005, 7 pages.
Scheirer E. et al., "Audio BIFS: Describing Audio Scenes with the MPEG-4 Multimedia Standard", IEEE Transactions on Multimedia, vol. 1, No. 3, Sep. 1999, 14 pages.

* cited by examiner

| Harmonic Information Regarding Object Signal | Mixing/Rendering Information |
| --- | --- |

METHODS AND APPARATUSES FOR ENCODING AND DECODING OBJECT-BASED AUDIO SIGNALS

RELATED APPLICATION

This application claims the benefit of priority from U.S. Provisional Patent Application No. 60/848,293, for "Effective Coding Method for Applying Spatial Audio Object Coding and Sound Image Panning," filed Sep. 29, 2006, which application is incorporated by reference herein in its entirety.

This application claims the benefit of priority from U.S. Provisional Patent Application No. 60/829,800, for "Method for Coding Audio Signal Based on Object Signal," filed Oct. 17, 2006, which application is incorporated by reference herein in its entirety.

This application claims the benefit of priority from U.S. Provisional Patent Application No. 60/863,303, for "Effective Coding Method for Applying Spatial Audio Object Coding," filed Oct. 27, 2006, which application is incorporated by reference herein in its entirety.

This application claims the benefit of priority from U.S. Provisional Patent Application No. 60/860,823, filed Nov. 24, 2006, which application is incorporated by reference herein in its entirety.

This application claims the benefit of priority from U.S. Provisional Patent Application No. 60/880,714, filed Jan. 17, 2007, which application is incorporated by reference herein in its entirety.

This application claims the benefit of priority from U.S. Provisional Patent Application No. 60/880,942, filed Jan. 18, 2007, which application is incorporated by reference herein in its entirety.

This application claims the benefit of priority from U.S. Provisional Patent Application No. 60/948,373, filed Jul. 6, 2007, which application is incorporated by reference herein in its entirety.

BACKGROUND OF THE INVENTION

1. Field of the Invention

The present invention relates to an audio encoding method and apparatus and an audio decoding method and apparatus in which sound images can be localized at any desired position for each object audio signal.

2. Description of the Related Art

In general, in multi-channel audio encoding and decoding techniques, a number of channel signals of a multi-channel signal are downmixed into fewer channel signals, side information regarding the original channel signals is transmitted, and a multi-channel signal having as many channels as the original multi-channel signal is restored.

Object-based audio encoding and decoding techniques are basically similar to multi-channel audio encoding and decoding techniques in terms of downmixing several sound sources into fewer sound source signals and transmitting side information regarding the original sound sources. However, in object-based audio encoding and decoding techniques, object signals, which are basic elements (e.g., the sound of a musical instrument or a human voice) of a channel signal, are treated the same as channel signals in multi-channel audio encoding and decoding techniques and can thus be coded.

In other words, in object-based audio encoding and decoding techniques, each object signal is deemed the entity to be coded. In this regard, object-based audio encoding and decoding techniques are different from multi-channel audio encoding and decoding techniques in which a multi-channel audio coding operation is performed simply based on inter-channel information regardless of the number of elements of a channel signal to be coded.

SUMMARY OF THE INVENTION

The present invention provides an audio encoding method and apparatus and an audio decoding method and apparatus in which audio signals can be encoded or decoded so that sound images can be localized at any desired position for each object audio signal.

According to an aspect of the present invention, there is provided an audio decoding method including extracting a downmix signal and object-based side information from an audio signal; generating channel-based side information based on object-based side information and control information for rendering the downmix signal; processing the downmix signal using a decorrelated channel signal; and generating a multi-channel audio signal using the processed downmix signal and the channel-based side information.

According to another aspect of the present invention, there is provided an audio decoding apparatus including a demultiplexer which extracts a downmix signal and object-based side information from an audio signal; a parameter converter which generates channel-based side information based on object-based side information and control information for rendering the downmix signal; a downmix processor which modifies the downmix signal by decorrelated downmix signal if the downmix signal is a stereo downmix signal; and a multi-channel decoder which generates a multi-channel audio signal using a modified downmix signal obtained by the downmix processor and the channel-based side information.

According to another aspect of the present invention, there is provided an audio decoding method including extracting a downmix signal and object-based side information from an audio signal; generating channel-based side information and one or more processing parameters based on object-based side information and control information for rendering the downmix signal; generating a multi-channel audio signal using the downmix signal and the channel-based side information; and modifying the multi-channel audio signal using the processing parameters.

According to another aspect of the present invention, there is provided an audio decoding apparatus including a demultiplexer which extracts a downmix signal and object-based side information from an audio signal; a parameter converter which generates channel-based side information and one or more processing parameters based on object-based side information and control information for rendering the downmix signal; a multi-channel decoder which generates a multi-channel audio signal using the downmix signal and the channel-based side information; and a channel processor which modifies the multi-channel audio signal using the processing parameters.

According to another aspect of the present invention, there is provided a computer-readable recording medium having recorded thereon an audio decoding method including extracting a downmix signal and object-based side information from an audio signal; generating channel-based side information based on object-based side information and control information for rendering the downmix signal; processing the downmix signal using a decorrelated channel signal; and generating a multi-channel audio signal using the processed downmix signal obtained by the swapping and the channel-based side information.

According to another aspect of the present invention, there is provided a computer-readable recording medium having recorded thereon an audio decoding method including extracting a downmix signal and object-based side information from an audio signal; generating channel-based side information and one or more processing parameters based on object-based side information and control information for rendering the downmix signal; generating a multi-channel audio signal using the downmix signal and the channel-based side information; and modifying the multi-channel audio signal using the processing parameters.

BRIEF DESCRIPTION OF THE DRAWINGS

The present invention will become more fully understood from the detailed description given hereinbelow and the accompanying drawings, which are given by illustration only, and thus are not limitative of the present invention, and wherein.

DESCRIPTION OF THE PREFERRED EMBODIMENT

The present invention will hereinafter be described in detail with reference to the accompanying drawings in which exemplary embodiments of the invention are shown.

An audio encoding method and apparatus and an audio decoding method and apparatus according to the present invention may be applied to object-based audio processing operations, but the present invention is not restricted to this. In other words, the audio encoding method and apparatus and the audio decoding method and apparatus may be applied to various signal processing operations other than object-based audio processing operations.

Figure 1:
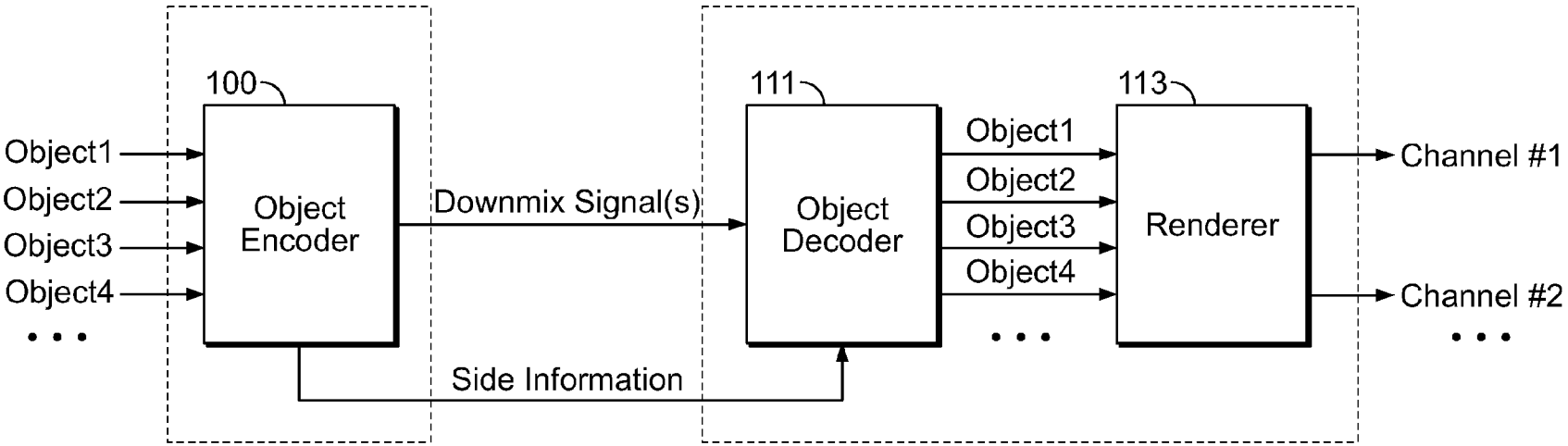
FIG. 1 is a block diagram of a typical object-based audio encoding/decoding system.

FIG. 1 is a block diagram of a typical object-based audio encoding/decoding system. In general, audio signals input to an object-based audio encoding apparatus do not correspond to channels of a multi-channel signal but are independent object signals. In this regard, an object-based audio encoding apparatus is differentiated from a multi-channel audio encoding apparatus to which channel signals of a multi-channel signal are input.

For example, channel signals such as a front left channel signal and a front right channel signal of a 5.1-channel signal may be input to a multi-channel audio signal, whereas object audio signals such as a human voice or the sound of a musical instrument (e.g., the sound of a violin or a piano) which are smaller entities than channel signals may be input to an object-based audio encoding apparatus.

Referring to FIG. 1, the object-based audio encoding/decoding system includes an object-based audio encoding apparatus and an object-based audio decoding apparatus. The object-based audio encoding apparatus includes an object encoder 100, and the object-based audio decoding apparatus includes an object decoder 111 and a renderer 113.

The object encoder 100 receives N object audio signals, and generates an object-based downmix signal with one or more channels and side information including a number of pieces of information extracted from the N object audio signals such as energy difference, phase difference, and correlation value. The side information and the object-based downmix signal are incorporated into a single bitstream, and the bitstream is transmitted to the object-based decoding apparatus.

The side information may include a flag indicating whether to perform channel-based audio coding or object-based audio coding, and thus, it may be determined whether to perform channel-based audio coding or object-based audio coding based on the flag of the side information. The side information may also include envelope information, grouping information, silent period information, and delay information regarding object signals. The side information may also include object level differences information, inter-object cross correlation information, downmix gain information, downmix channel level difference information, and absolute object energy information.

The object decoder 111 receives the object-based downmix signal and the side information from the object-based audio encoding apparatus, and restores object signals having similar properties to those of the N object audio signals based on the object-based downmix signal and the side information. The object signals generated by the object decoder 111 have not yet been allocated to any position in a multi-channel space. Thus, the renderer 113 allocates each of the object signals generated by the object decoder 111 to a predetermined position in a multi-channel space and determines the levels of the object signals so that the object signals can be reproduced from respective corresponding positions designated by the renderer 113 with respective corresponding levels determined by the renderer 113. Control information regarding each of the object signals generated by the object decoder 111 may vary over time, and thus, the spatial positions and the levels of the object signals generated by the object decoder 111 may vary according to the control information.

Figure 2:
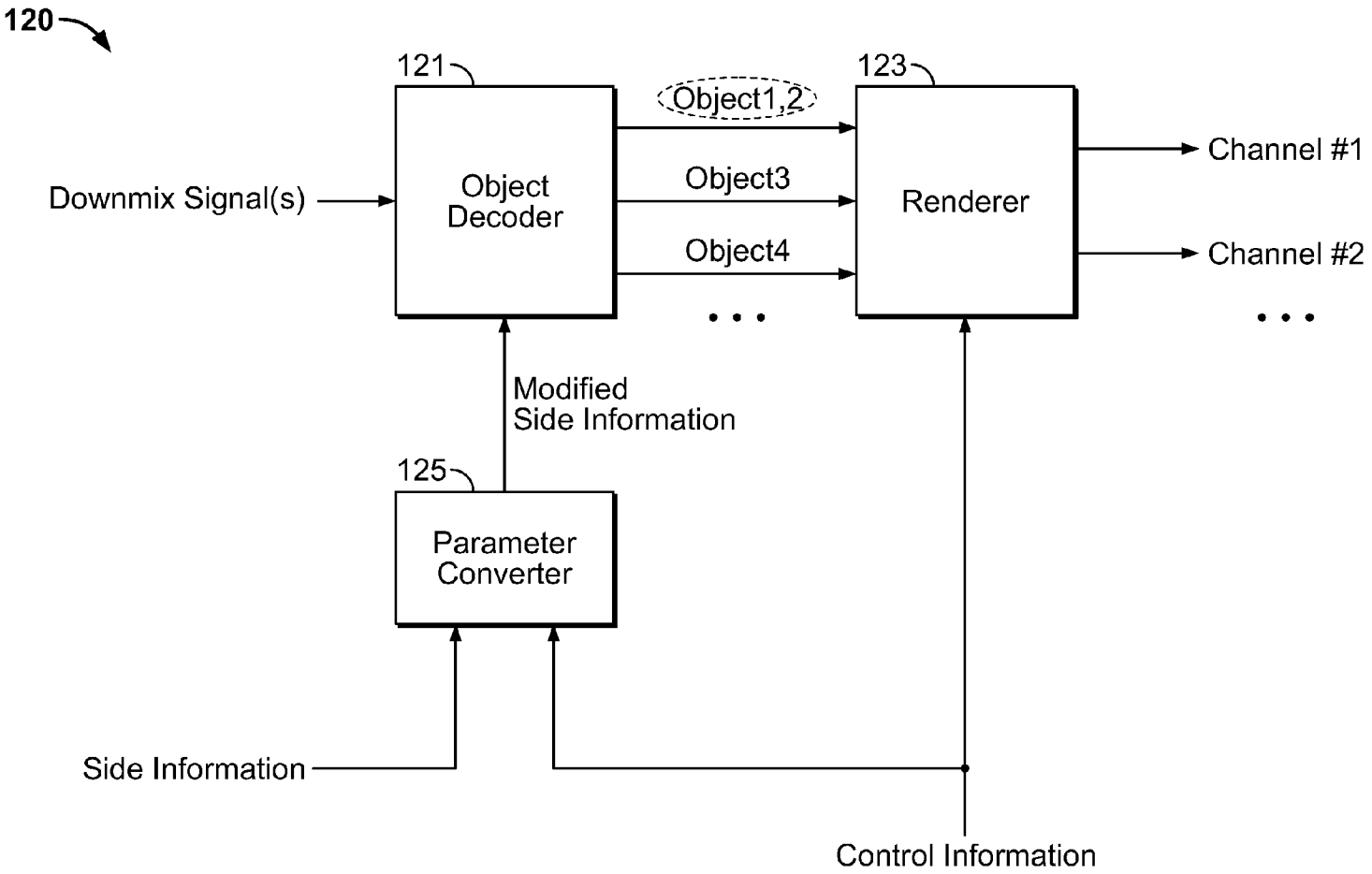
FIG. 2 is a block diagram of an audio decoding apparatus according to a first embodiment of the present invention.

FIG. 2 is a block diagram of an audio decoding apparatus 120 according to a first embodiment of the present invention. Referring to FIG. 2, the audio decoding apparatus 120 includes an object decoder 121, a renderer 123, and a parameter converter 125. The audio decoding apparatus 120 may also include a demultiplexer (not shown) which extracts a downmix signal and side information from a bitstream input thereto, and this will apply to all audio decoding apparatuses according to other embodiments of the present invention.

The object decoder 121 generates a number of object signals based on a downmix signal and modified side information provided by the parameter converter 125. The renderer 123 allocates each of the object signals generated by the object decoder 121 to a predetermined position in a multi-channel space and determines the levels of the object signals generated by the object decoder 121 according to control information. The parameter converter 125 generates the modified side information by combining the side information and the control information. Then, the parameter converter 125 transmits the modified side information to the object decoder 121.

The object decoder 121 may be able to perform adaptive decoding by analyzing the control information in the modified side information.

For example, if the control information indicates that a first object signal and a second object signal are allocated to the same position in a multi-channel space and have the same level, a typical audio decoding apparatus may decode the first and second object signals separately, and then arrange them in a multi-channel space through a mixing/rendering operation.

On the other hand, the object decoder 121 of the audio decoding apparatus 120 learns from the control information in the modified side information that the first and second object signals are allocated to the same position in a multi-channel space and have the same level as if they were a single sound source. Accordingly, the object decoder 121 decodes the first and second object signals by treating them as a single sound source without decoding them separately. As a result, the complexity of decoding decreases. In addition, due to a decrease in the number of sound sources that need to be processed, the complexity of mixing/rendering also decreases.

The audio decoding apparatus 120 may be effectively used in the situation when the number of object signals is greater than the number of output channels because a plurality of object signals are highly likely to be allocated to the same spatial position.

Alternatively, the audio decoding apparatus 120 may be used in the situation when the first object signal and the second object signal are allocated to the same position in a multi-channel space but have different levels. In this case, the audio decoding apparatus 120 decode the first and second object signals by treating the first and second object signals as a single, instead of decoding the first and second object signals separately and transmitting the decoded first and second object signals to the renderer 123. More specifically, the object decoder 121 may obtain information regarding the difference between the levels of the first and second object signals from the control information in the modified side information, and decode the first and second object signals based on the obtained information. As a result, even if the first and second object signals have different levels, the first and second object signals can be decoded as if they were a single sound source.

Still alternatively, the object decoder 121 may adjust the levels of the object signals generated by the object decoder 121 according to the control information. Then, the object decoder 121 may decode the object signals whose levels are adjusted. Accordingly, the renderer 123 does not need to adjust the levels of the decoded object signals provided by the object decoder 121 but simply arranges the decoded object signals provided by the object decoder 121 in a multi-channel space. In short, since the object decoder 121 adjusts the levels of the object signals generated by the object decoder 121 according to the control information, the renderer 123 can readily arrange the object signals generated by the object decoder 121 in a multi-channel space without the need to additionally adjust the levels of the object signals generated by the object decoder 121. Therefore, it is possible to reduce the complexity of mixing/rendering.

According to the embodiment of FIG. 2, the object decoder of the audio decoding apparatus 120 can adaptively perform a decoding operation through the analysis of the control information, thereby reducing the complexity of decoding and the complexity of mixing/rendering. A combination of the above-described methods performed by the audio decoding apparatus 120 may be used.

Figure 3:
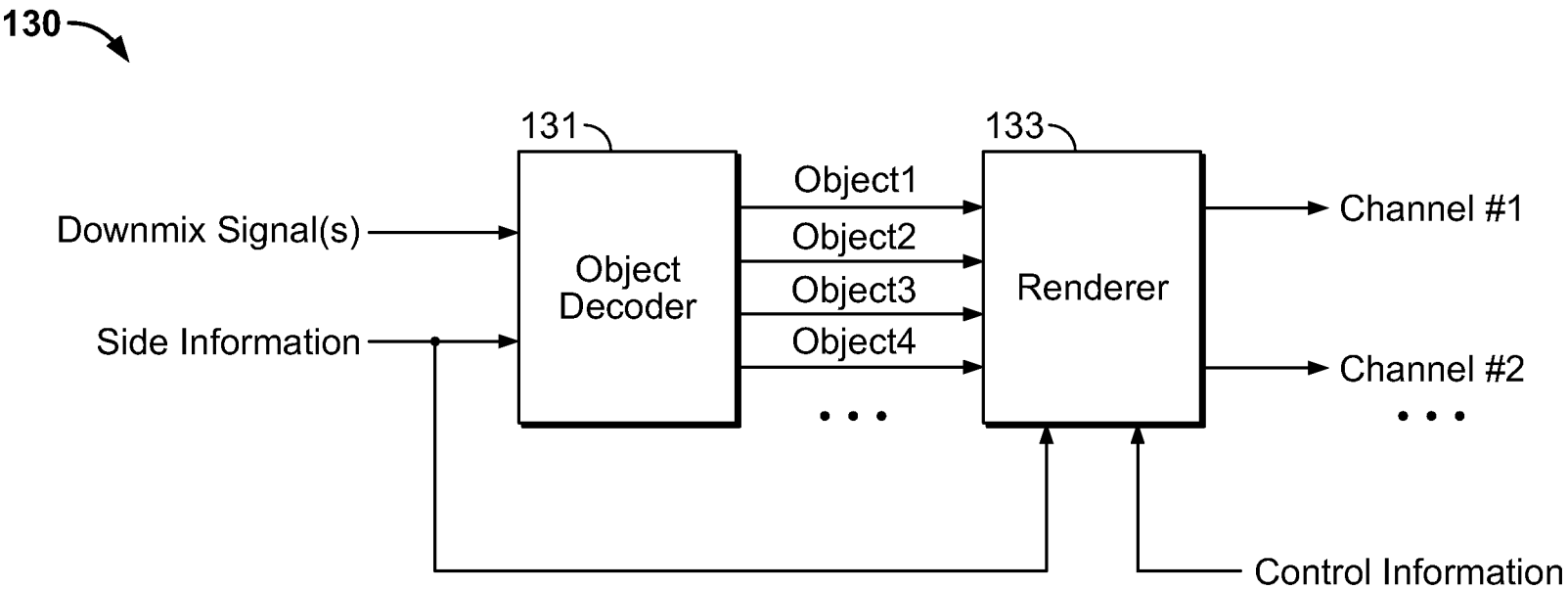
FIG. 3 is a block diagram of an audio decoding apparatus according to a second embodiment of the present invention.

FIG. 3 is a block diagram of an audio decoding apparatus 130 according to a second embodiment of the present invention. Referring to FIG. 3, the audio decoding apparatus 130 includes an object decoder 131 and a renderer 133. The audio decoding apparatus 130 is characterized by providing side information not only to the object decoder 131 but also to the renderer 133.

The audio decoding apparatus 130 may effectively perform a decoding operation even when there is an object signal corresponding to a silent period. For example, second through fourth object signals may correspond to a music play period during which a musical instrument is played, and a first object signal may correspond to a silent period during which an accompaniment is played. In this case, information indicating which of a plurality of object signals corresponds to a silent period may be included in side information, and the side information may be provided to the renderer 133 as well as to the object decoder 131.

The object decoder 131 may minimize the complexity of decoding by not decoding an object signal corresponding to a silent period. The object decoder 131 sets an object signal corresponding to a value of 0 and transmits the level of the object signal to the renderer 133. In general, object signals having a value of 0 are treated the same as object signals having a value, other than 0, and are thus subjected to a mixing/rendering operation.

On the other hand, the audio decoding apparatus 130 transmits side information including information indicating which of a plurality of object signals corresponds to a silent period to the renderer 133 and can thus prevent an object signal corresponding to a silent period from being subjected to a mixing/rendering operation performed by the renderer 133. Therefore, the audio decoding apparatus 130 can prevent an unnecessary increase in the complexity of mixing/rendering.

The renderer 133 may use mixing parameter information which is included in control information to localize a sound image of each object signal at a stereo scene. The mixing parameter information may include amplitude information only or both amplitude information and time information. The mixing parameter information affects not only the localization of stereo sound images but also the psychoacoustic perception of a spatial sound quality by a user.

For example, upon comparing two sound images which are generated using a time panning method and an amplitude panning method, respectively, and reproduced at the same location using a 2-channel stereo speaker, it is recognized that the amplitude panning method can contribute to a precise localization of sound images, and that the time panning method can provide natural sounds with a profound feeling of space. Thus, if the renderer 133 only uses the amplitude panning method to arrange object signals in a multi-channel space, the renderer 133 may be able to precisely localize each sound image, but may not be able to provide as profound a feeling of sound as when using the time panning method. Users may sometime prefer a precise localization of sound images to a profound feeling of sound or vice versa according to the type of sound sources.

Figure 4A:
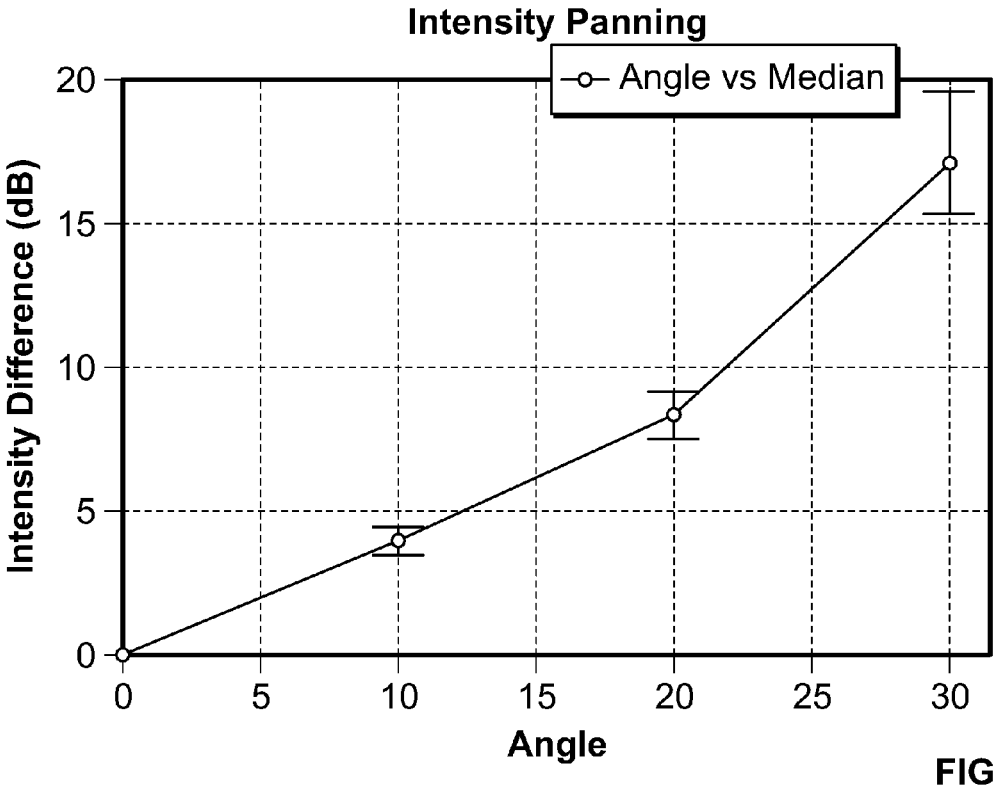
FIG. 4 is a graph for explaining the influence of an amplitude difference and a time difference, which are independent from each other, on the localization of sound images.
Figure 4B:
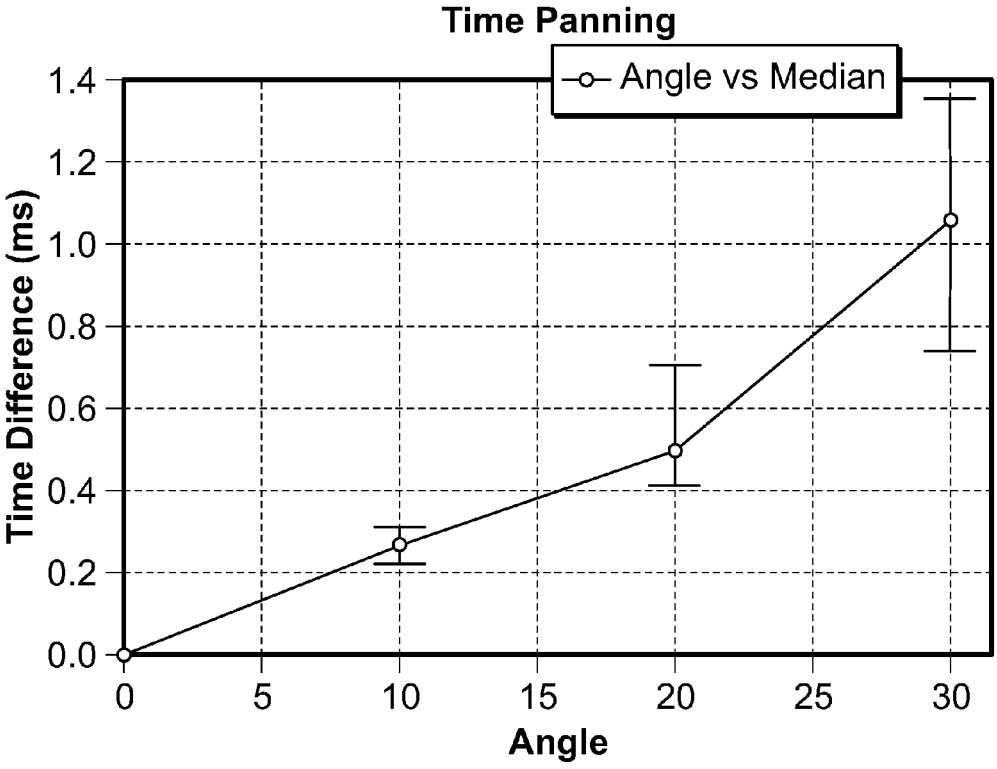

FIGS. 4(*a*) and 4(*b*) explains the influence of intensity (amplitude difference) and a time difference on the localization of sound images as performed in the reproduction of signals with a 2-channel stereo speaker. Referring to FIGS. 4(*a*) and 4(*b*), a sound image may be localized at a predetermined angle according to an amplitude difference and a time difference which are independent from each other. For example, an amplitude difference of about 8 dB or a time difference of about 0.5 ms, which is equivalent to the amplitude difference of 8 dB, may be used in order to localize a sound image at an angle of 20°. Therefore, even if only an amplitude difference is provided as mixing parameter information, it is possible to obtain various sounds with different properties by converting the amplitude difference into a time difference which is equivalent to the amplitude difference during the localization of sound images.

Figures 5, 6:
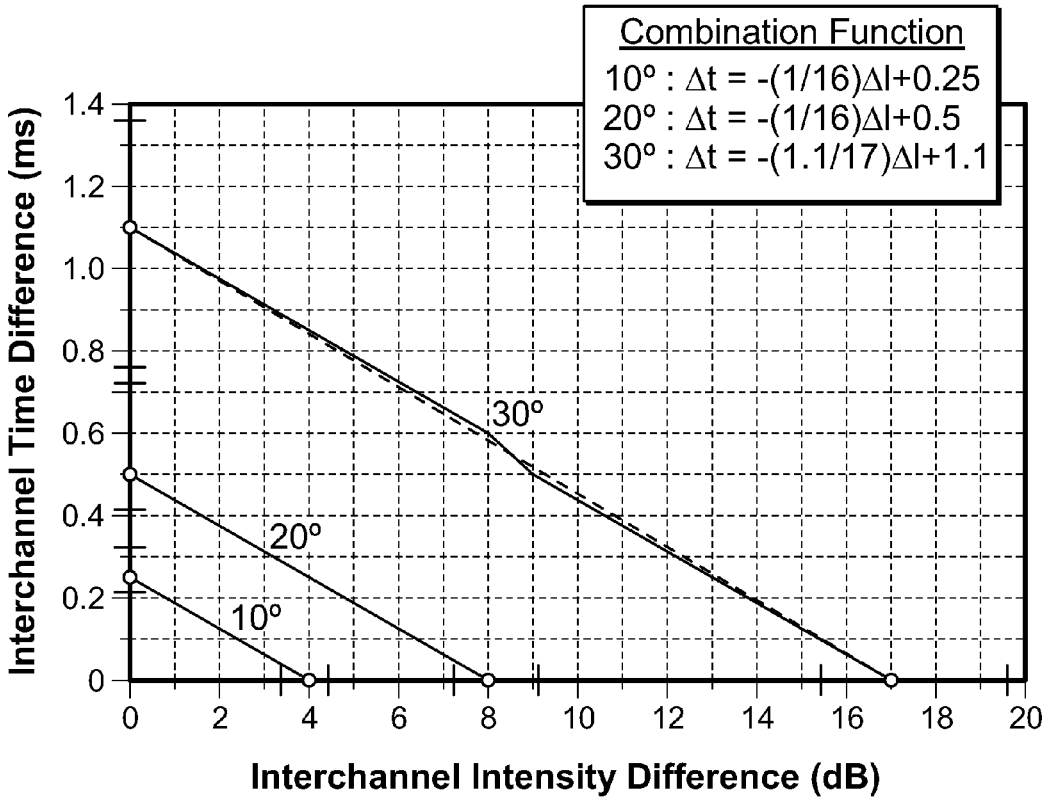
FIG. 5 is a graph of functions regarding the correspondence between amplitude differences and time differences which are required to localize sound images at a predetermined position.
FIG. 6 illustrates the format of control data including harmonic information.

FIG. 5 illustrates functions regarding the correspondence between amplitude differences and time differences which are required to localize sound images at angles of 10°, 20°, and 30°. The function illustrated in FIG. 5 may be obtained based on FIGS. 4(*a*) and 4(*b*). Referring to FIG. 5, various amplitude difference-time difference combinations may be provided for localizing a sound image at a predetermined position. For example, assume that an amplitude difference of 8 dB is provided as mixing parameter information in order to localize a sound image at an angle of 20°. According to the function illustrated in FIG. 5, a sound image can also be localized at the angle of 20° using the combination of an amplitude difference of 3 dB and a time difference of 0.3 ms. In this case, not only amplitude difference information but also time difference information may be provided as mixing parameter information, thereby enhancing the feeling of space.

Therefore, in order to generate sounds with properties desired by a user during a mixing/rendering operation, mixing parameter information may be appropriately converted so that whichever of amplitude panning and time panning suits the user can be performed. That is, if mixing parameter information only includes amplitude difference information and the user wishes for sounds with a profound feeling of space, the amplitude difference information may be converted into time difference information equivalent to the amplitude difference information with reference to psychoacoustic data. Alternatively, if the user wishes for both sounds with a profound feeling of space and a precise localization of sound images, the amplitude difference information may be converted into the combination of amplitude difference information and time difference information equivalent to the original amplitude information.

Alternatively, if mixing parameter information only includes time difference information and a user prefers a precise localization of sound images, the time difference information may be converted into amplitude difference information equivalent to the time difference information, or may be converted into the combination of amplitude difference information and time difference information which can satisfy the user's preference by enhancing both the precision of localization of sound images and the feeling of space.

Still alternatively, if mixing parameter information includes both amplitude difference information and time difference information and a user prefers a precise localization of sound images, the combination of the amplitude difference information and the time difference information may be converted into amplitude difference information equivalent to the combination of the original amplitude difference information and the time difference information. On the other hand, if mixing parameter information includes both amplitude difference information and time difference information and a user prefers the enhancement of the feeling of space, the combination of the amplitude difference information and the time difference information may be converted into time difference information equivalent the combination of the amplitude difference information and the original time difference information.

Referring to FIG. 6, control information may include mixing/rendering information and harmonic information regarding one or more object signals. The harmonic information may include at least one of pitch information, fundamental frequency information, and dominant frequency band information regarding one or more object signals, and descriptions of the energy and spectrum of each sub-band of each of the object signals.

The harmonic information may be used to process an object signal during a rendering operation because the resolution of a renderer which performs its operation in units of sub-bands is insufficient.

If the harmonic information includes pitch information regarding one or more object signals, the gain of each of the object signals may be adjusted by attenuating or strengthening a predetermined frequency domain using a comb filter or an inverse comb filter. For example, if one of a plurality of object signals is a vocal signal, the object signals may be used as a karaoke by attenuating only the vocal signal. Alternatively, if the harmonic information includes dominant frequency domain information regarding one or more object signals, a process of attenuating or strengthening a dominant frequency domain may be performed. Still alternatively, if the harmonic information includes spectrum information regarding one or more object signals, the gain of each of the object signals may be controlled by performing attenuation or enforcement without being restricted by any sub-band boundaries.

Figure 7:
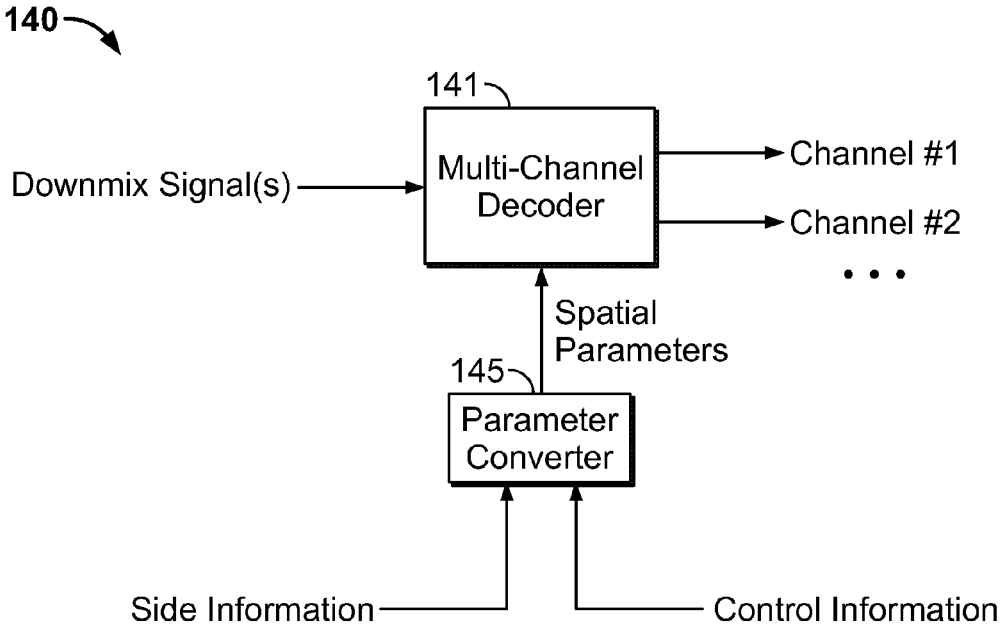
FIG. 7 is a block diagram of an audio decoding apparatus according to a third embodiment of the present invention.

FIG. 7 is a block diagram of an audio decoding apparatus 140 according to another embodiment of the present invention. Referring to FIG. 7, the audio decoding apparatus 140 uses a multi-channel decoder 141, instead of an object decoder and a renderer, and decodes a number of object signals after the object signals are appropriately arranged in a multi-channel space.

More specifically, the audio decoding apparatus 140 includes the multi-channel decoder 141 and a parameter converter 145. The multi-channel decoder 141 generates a multi-channel signal whose object signals have already been arranged in a multi-channel space based on a down-mix signal and spatial parameter information, which is channel-based side information provided by the parameter converter 145. The parameter converter 145 analyzes side information and control information transmitted by an audio encoding apparatus (not shown), and generates the spatial parameter information based on the result of the analysis. More specifically, the parameter converter 145 generates the spatial parameter information by combining the side information and the control information which includes playback setup information and mixing information. That is, the parameter conversion 145 performs the conversion of the combination of the side information and the control information to spatial data corresponding to a One-To-Two (OTT) box or a Two-To-Three (TTT) box.

The audio decoding apparatus 140 may perform a multi-channel decoding operation into which an object-based decoding operation and a mixing/rendering operation are incorporated and may thus skip the decoding of each object signal. Therefore, it is possible to reduce the complexity of decoding and/or mixing/rendering.

For example, when there are 10 object signals and a multi-channel signal obtained based on the 10 object signals is to be reproduced by a 5.1 channel speaker reproduction system, a typical object-based audio decoding apparatus generates decoded signals respectively corresponding the 10 object signals based on a down-mix signal and side information and then generates a 5.1 channel signal by appropriately arranging the 10 object signals in a multi-channel space so that the object signals can become suitable for a 5.1 channel speaker environment. However, it is inefficient to generate 10 object signals during the generation of a 5.1 channel signal, and this problem becomes more severe as the difference between the number of object signals and the number of channels of a multi-channel signal to be generated increases.

On the other hand, according to the embodiment of FIG. 7, the audio decoding apparatus 140 generates spatial parameter information suitable for a 5.1-channel signal based on side information and control information, and provides the spatial parameter information and a downmix signal to the multi-channel decoder 141. Then, the multi-channel decoder 141 generates a 5.1 channel signal based on the spatial parameter information and the downmix signal. In other words, when the number of channels to be output is 5.1 channels, the audio decoding apparatus 140 can readily generate a 5.1-channel signal based on a downmix signal without the need to generate 10 object signals and is thus more efficient than a conventional audio decoding apparatus in terms of complexity.

The audio decoding apparatus 140 is deemed efficient when the amount of computation required to calculates spatial parameter information corresponding to each of an OTT box and a TTT box through the analysis of side information and control information transmitted by an audio encoding apparatus is less than the amount of computation required to perform a mixing/rendering operation after the decoding of each object signal.

The audio decoding apparatus 140 may be obtained simply by adding a module for generating spatial parameter information through the analysis of side information and control information to a typical multi-channel audio decoding apparatus, and may thus maintain the compatibility with a typical multi-channel audio decoding apparatus. Also, the audio decoding apparatus 140 can improve the quality of sound using existing tools of a typical multi-channel audio decoding apparatus such as an envelope shaper, a sub-band temporal processing (STP) tool, and a decorrelator. Given all this, it is concluded that all the advantages of a typical multi-channel audio decoding method can be readily applied to an object-audio decoding method.

Spatial parameter information transmitted to the multi-channel decoder 141 by the parameter converter 145 may have been compressed so as to be suitable for being transmitted. Alternatively, the spatial parameter information may have the same format as that of data transmitted by a typical multi-channel encoding apparatus. That is, the spatial parameter information may have been subjected to a Huffman decoding operation or a pilot decoding operation and may thus be transmitted to each module as uncompressed spatial cue data. The former is suitable for transmitting the spatial parameter information to a multi-channel audio decoding apparatus in a remote place, and the later is convenient because there is no need for a multi-channel audio decoding apparatus to convert compressed spatial cue data into uncompressed spatial cue data that can readily be used in a decoding operation.

The configuration of spatial parameter information based on the analysis of side information and control information may cause a delay between a downmix signal and the spatial parameter information. In order to address this, an additional buffer may be provided either for a downmix signal or for spatial parameter information so that the downmix signal and the spatial parameter information can be synchronized with each other. These methods, however, are inconvenient because of the requirement to provide an additional buffer. Alternatively, side information may be transmitted ahead of a downmix signal in consideration of the possibility of occurrence of a delay between a downmix signal and spatial parameter information. In this case, spatial parameter information obtained by combining the side information and control information does not need to be adjusted but can readily be used.

If a plurality of object signals of a downmix signal have different levels, an artistic downmix gains (ADG) module which can directly compensate for the downmix signal may determine the relative levels of the object signals, and each of the object signals may be allocated to a predetermined position in a multi-channel space using spatial cue data such as channel level difference information, inter-channel correlation (ICC) information, and channel prediction coefficient (CPC) information.

For example, if control information indicates that a predetermined object signal is to be allocated to a predetermined position in a multi-channel space and has a higher level than other object signals, a typical multi-channel decoder may calculate the difference between the energies of channels of a downmix signal, and divide the downmix signal into a number of output channels based on the results of the calculation. However, a typical multi-channel decoder cannot increase or reduce the volume of a certain sound in a downmix signal. In other words, a typical multi-channel decoder simply distributes a downmix signal to a number of output channels and thus cannot increase or reduce the volume of a sound in the downmix signal.

It is relatively easy to allocate each of a number of object signals of a downmix signal generated by an object encoder to a predetermined position in a multi-channel space according to control information. However, special techniques are required to increase or reduce the amplitude of a predetermined object signal. In other words, if a downmix signal generated by an object encoder is used as it is, it is difficult to reduce the amplitude of each object signal of the downmix signal.

Figure 8:
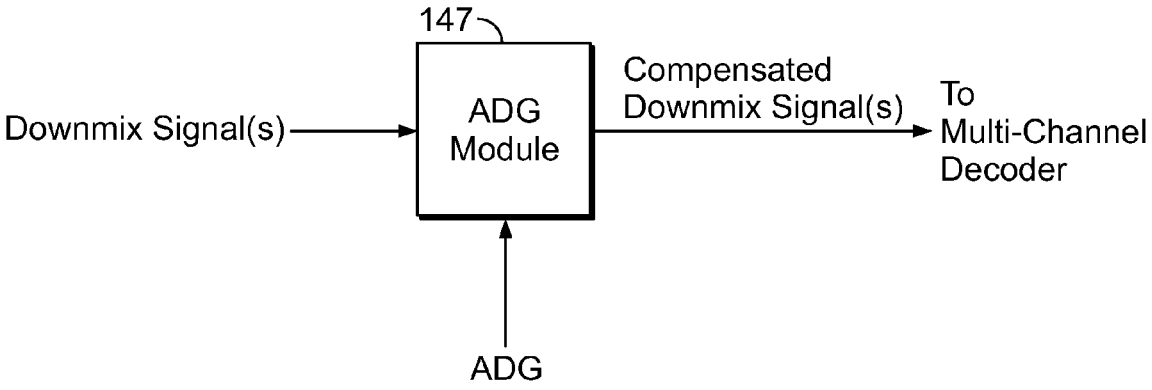
FIG. 8 is a block diagram of an artistic downmix gains (ADG) module that can be used in the audio decoding apparatus illustrated in FIG. 7.

Therefore, according to an embodiment of the present invention, the relative amplitudes of object signals may be varied according to control information using an ADG module 147 illustrated in FIG. 8. More specifically, the amplitude of any one of a plurality of object signals of a downmix signal transmitted by an object encoder may be increased or reduced using the ADG module 147. A downmix signal obtained by compensation performed by the ADG module 147 may be subjected to multi-channel decoding.

If the relative amplitudes of object signals of a downmix signal are appropriately adjusted using the ADG module 147, it is possible to perform object decoding using a typical multi-channel decoder. If a downmix signal generated by an object encoder is a mono or stereo signal or a multi-channel signal with three or more channels, the downmix signal may be processed by the ADG module 147. If a downmix signal generated by an object encoder has two or more channels and a predetermined object signal that needs to be adjusted by the ADG module 147 only exists in one of the channels of the downmix signal, the ADG module 147 may be applied only to the channel including the predetermined object signal, instead of being applied to all the channels of the downmix signal. A downmix signal processed by the ADG module 147 in the above-described manner may be readily processed using a typical multi-channel decoder without the need to modify the structure of the multi-channel decoder.

Even when a final output signal is not a multi-channel signal that can be reproduced by a multi-channel speaker but is a binaural signal, the ADG module 147 may be used to adjust the relative amplitudes of object signals of the final output signal.

Alternatively to the use of the ADG module 147, gain information specifying a gain value to be applied to each object signal may be included in control information during the generation of a number of object signals. For this, the structure of a typical multi-channel decoder may be modified. Even though requiring a modification to the structure of an existing multi-channel decoder, this method is convenient in terms of reducing the complexity of decoding by applying a gain value to each object signal during a decoding operation without the need to calculate ADG and to compensate for each object signal.

Figure 9:
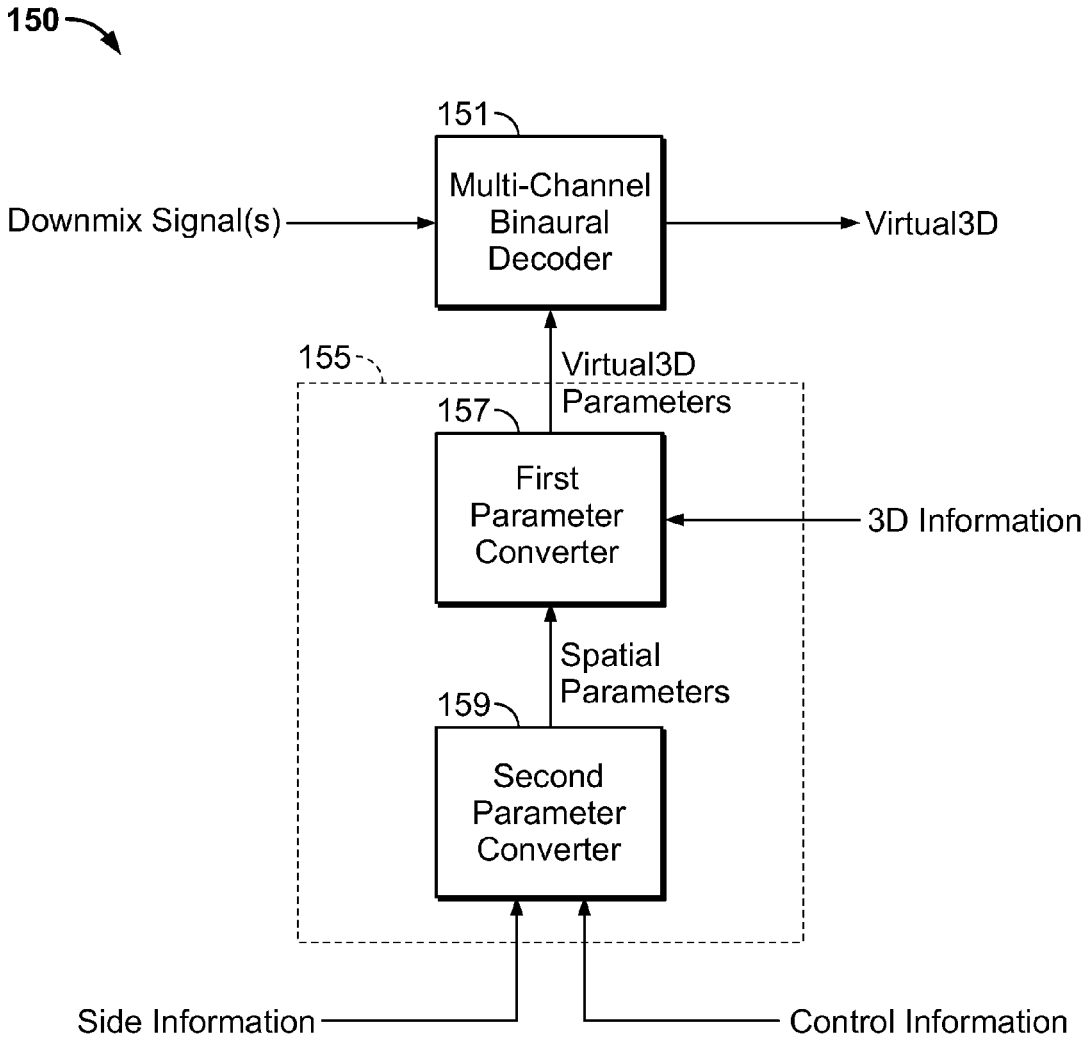
FIG. 9 is a block diagram of an audio decoding apparatus according to a fourth embodiment of the present invention.

FIG. 9 is a block diagram of an audio decoding apparatus 150 according to a fourth embodiment of the present invention. Referring to FIG. 9, the audio decoding apparatus 150 is characterized by generating a binaural signal.

More specifically, the audio decoding apparatus 150 includes a multi-channel binaural decoder 151, a first parameter converter 157, and a second parameter converter 159.

The second parameter converter 159 analyzes side information and control information which are provided by an audio encoding apparatus, and configures spatial parameter information based on the result of the analysis. The first parameter converter 157 configures binaural parameter information, which can be used by the multi-channel binaural decoder 151, by adding three-dimensional (3D) information such as head-related transfer function (HRTF) parameters to the spatial parameter information. The multi-channel binaural decoder 151 generates a virtual three-dimensional (3D) signal by applying the virtual 3D parameter information to a downmix signal.

The first parameter converter 157 and the second parameter converter 159 may be replaced by a single module, i.e., a parameter conversion module 155 which receives the side information, the control information, and the HRTF parameters and configures the binaural parameter information based on the side information, the control information, and the HRTF parameters.

Conventionally, in order to generate a binaural signal for the reproduction of a downmix signal including 10 object signals with a headphone, an object signal must generate 10 decoded signals respectively corresponding to the 10 object signals based on the downmix signal and side information. Thereafter, a renderer allocates each of the 10 object signals to a predetermined position in a multi-channel space with reference to control information so as to suit a 5-channel speaker environment. Thereafter, the renderer generates a 5-channel signal that can be reproduced using a 5-channel speaker. Thereafter, the renderer applies HRTF parameters to the 5-channel signal, thereby generating a 2-channel signal. In short, the above-mentioned conventional audio decoding method includes reproducing 10 object signals, converting the 10 object signals into a 5-channel signal, and generating a 2-channel signal based on the 5-channel signal, and is thus inefficient.

On the other hand, the audio decoding apparatus 150 can readily generate a binaural signal that can be reproduced using a headphone based on object audio signals. In addition, the audio decoding apparatus 150 configures spatial parameter information through the analysis of side information and control information, and can thus generate a binaural signal using a typical multi-channel binaural decoder. Moreover, the audio decoding apparatus 150 still can use a typical multi-channel binaural decoder even when being equipped with an incorporated parameter converter which receives side information, control information, and HRTF parameters and configures binaural parameter information based on the side information, the control information, and the HRTF parameters.

Figure 10:
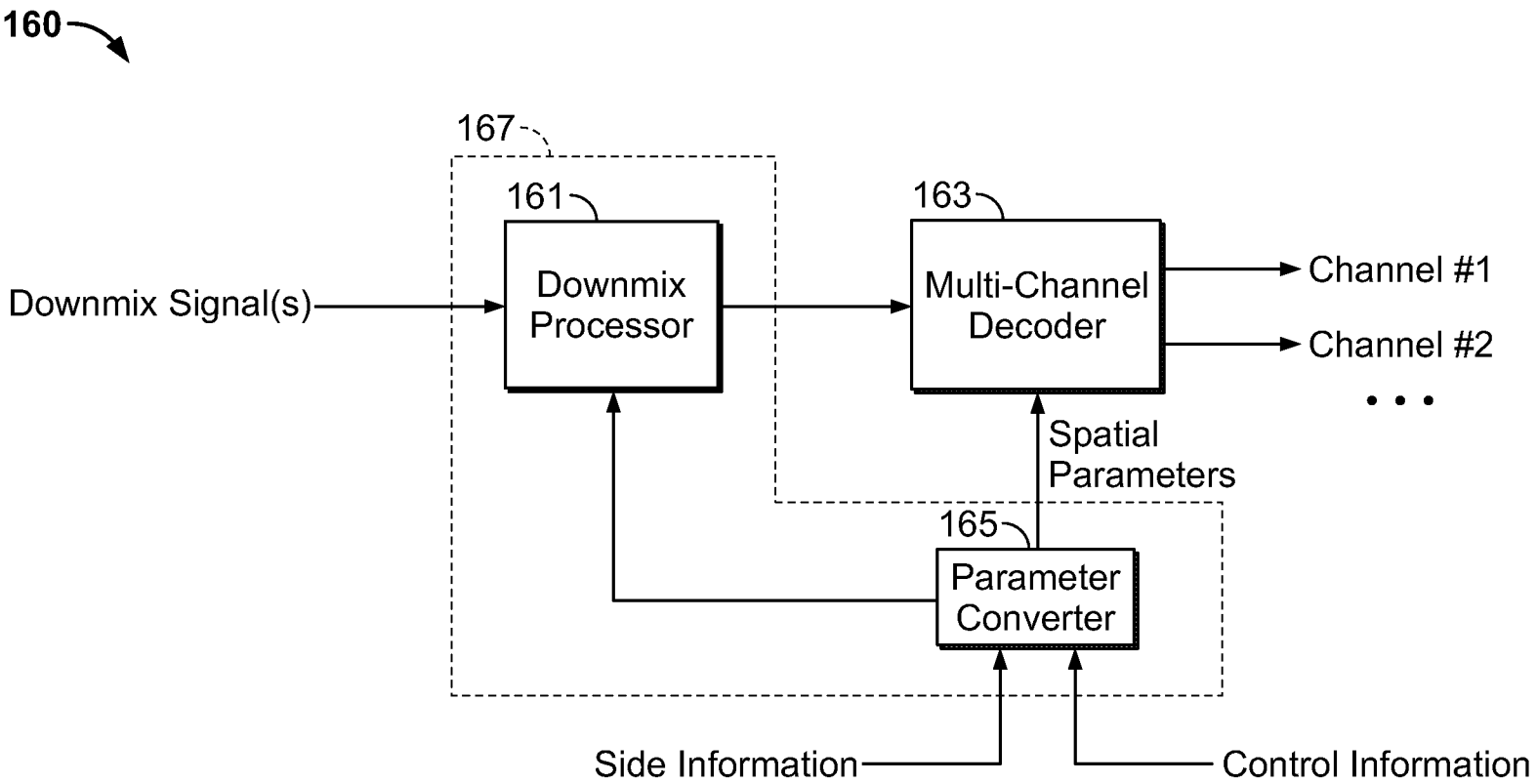
FIG. 10 is a block diagram of an audio decoding apparatus according to a fifth embodiment of the present invention.

FIG. 10 is a block diagram of an audio decoding apparatus 160 according to a fifth embodiment of the present invention. Referring to FIG. 10, the audio decoding apparatus 160 includes a downmix processor 161, a multi-channel decoder 163, and a parameter converter 165. The downmix processor 161 and the parameter converter 163 may be replaced by a single module 167.

The parameter converter 165 generates spatial parameter information, which can be used by the multi-channel decoder 163, and parameter information, which can be used by the downmix processor 161. The downmix processor 161 performs a pre-processing operation on a downmix signal, and transmits a downmix signal resulting from the pre-processing operation to the multi-channel decoder 163. The multi-channel decoder 163 performs a decoding operation on the downmix signal transmitted by the downmix processor 161, thereby outputting a stereo signal, a binaural stereo signal or a multi-channel signal. Examples of the pre-processing operation performed by the downmix processor 161 include the modification or conversion of a downmix signal in a time domain or a frequency domain using filtering.

If a downmix signal input to the audio decoding apparatus 160 is a stereo signal, the downmix signal may have be subjected to downmix preprocessing performed by the downmix processor 161 before being input to the multi-channel decoder 163 because the multi-channel decoder 163 cannot map a component of the downmix signal corresponding to a left channel, which is one of multiple channels, to a right channel, which is another of the multiple channels. Therefore, in order to shift the position of an object signal classified into the left channel to the direction of the right channel, the downmix signal input to the audio decoding apparatus 160 may be preprocessed by the downmix processor 161, and the preprocessed downmix signal may be input to the multi-channel decoder 163.

The preprocessing of a stereo downmix signal may be performed based on preprocessing information obtained from side information and from control information.

Figure 11:
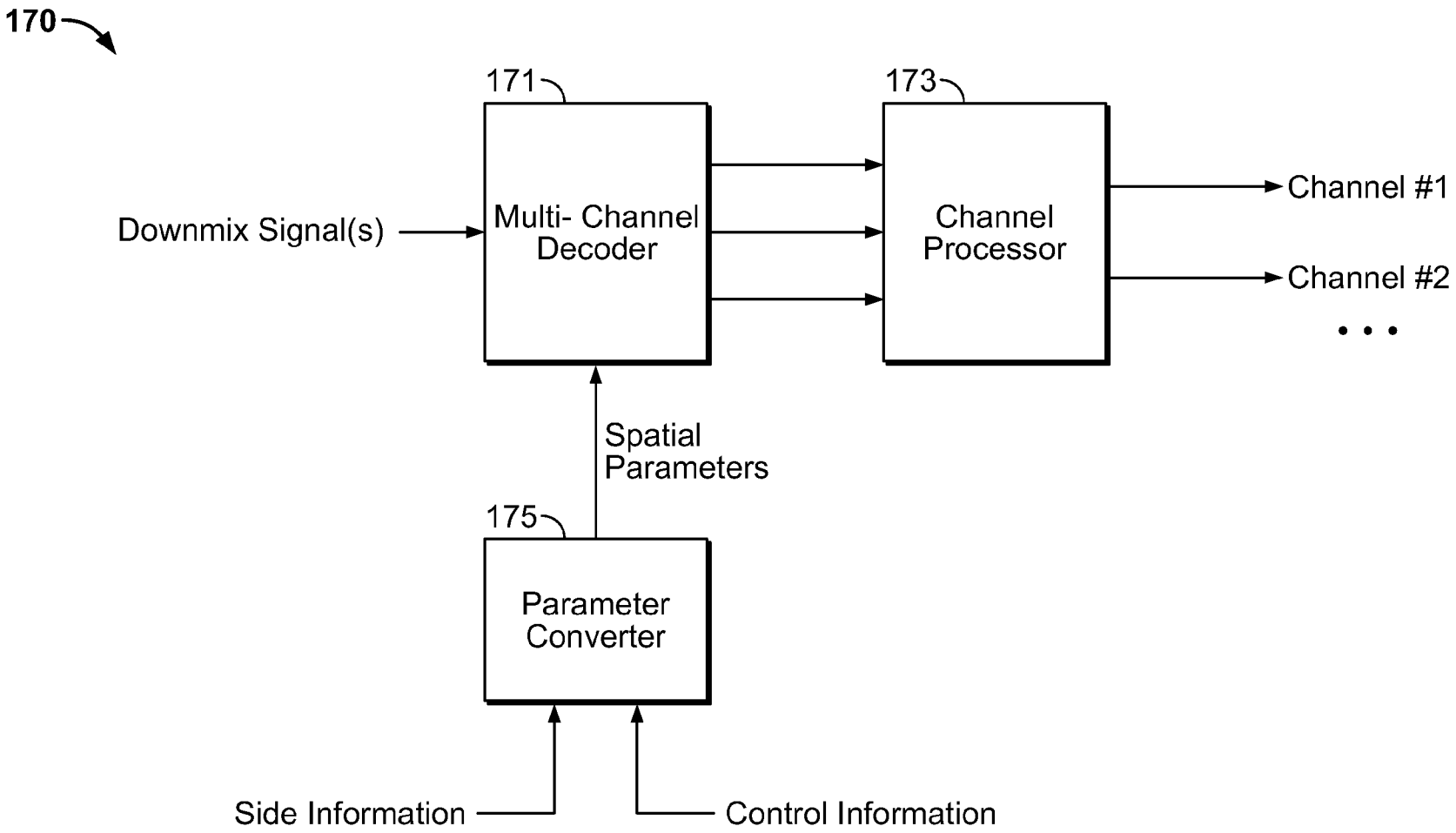
FIG. 11 is a block diagram of an audio decoding apparatus according to a sixth embodiment of the present invention.

FIG. 11 is a block diagram of an audio decoding apparatus 170 according to a sixth embodiment of the present invention. Referring to FIG. 11, the audio decoding apparatus 170 includes a multi-channel decoder 171, a channel processor 173, and a parameter converter 175.

The parameter converter 175 generates spatial parameter information, which can be used by the multi-channel decoder 173, and parameter information, which can be used by the channel processor 173. The channel processor 173 performs a post-processing operation on a signal output by the multi-channel decoder 173. Examples of the signal output by the multi-channel decoder 173 include a stereo signal, a binaural stereo signal and a multi-channel signal.

Examples of the post-processing operation performed by the post processor 173 include the modification and conversion of each channel or all channels of an output signal. For example, if side information includes fundamental frequency information regarding a predetermined object signal, the channel processor 173 may remove harmonic components from the predetermined object signal with reference to the fundamental frequency information. A multi-channel audio decoding method may not be efficient enough to be used in a karaoke system. However, if fundamental frequency information regarding vocal object signals is included in side information and harmonic components of the vocal object signals are removed during a post-processing operation, it is possible to realize a high-performance karaoke system using the embodiment of FIG. 11. The embodiment of FIG. 11 may also be applied to object signals, other than vocal object signals. For example, it is possible to remove the sound of a predetermined musical instrument using the embodiment of FIG. 11. Also, it is possible to amplify predetermined harmonic components using fundamental frequency information regarding object signals using the embodiment of FIG. 11.

The channel processor 173 may perform additional effect processing on a downmix signal. Alternatively, the channel processor 173 may add a signal obtained by the additional effect processing to a signal output by the multi-channel decoder 171. The channel processor 173 may change the spectrum of an object or modify a downmix signal whenever necessary. If it is not appropriate to directly perform an effect processing operation such as reverberation on a downmix signal and to transmit a signal obtained by the effect processing operation to the multi-channel decoder 171, the downmix processor 173 may add the signal obtained by the effect processing operation to the output of the multi-channel decoder 171, instead of performing effect processing on the downmix signal.

The audio decoding apparatus 170 may be designed to include not only the channel processor 173 but also a downmix processor. In this case, the downmix processor may be disposed in front of the multi-channel decoder 173, and the channel processor 173 may be disposed behind the multi-channel decoder 173.

Figure 12:
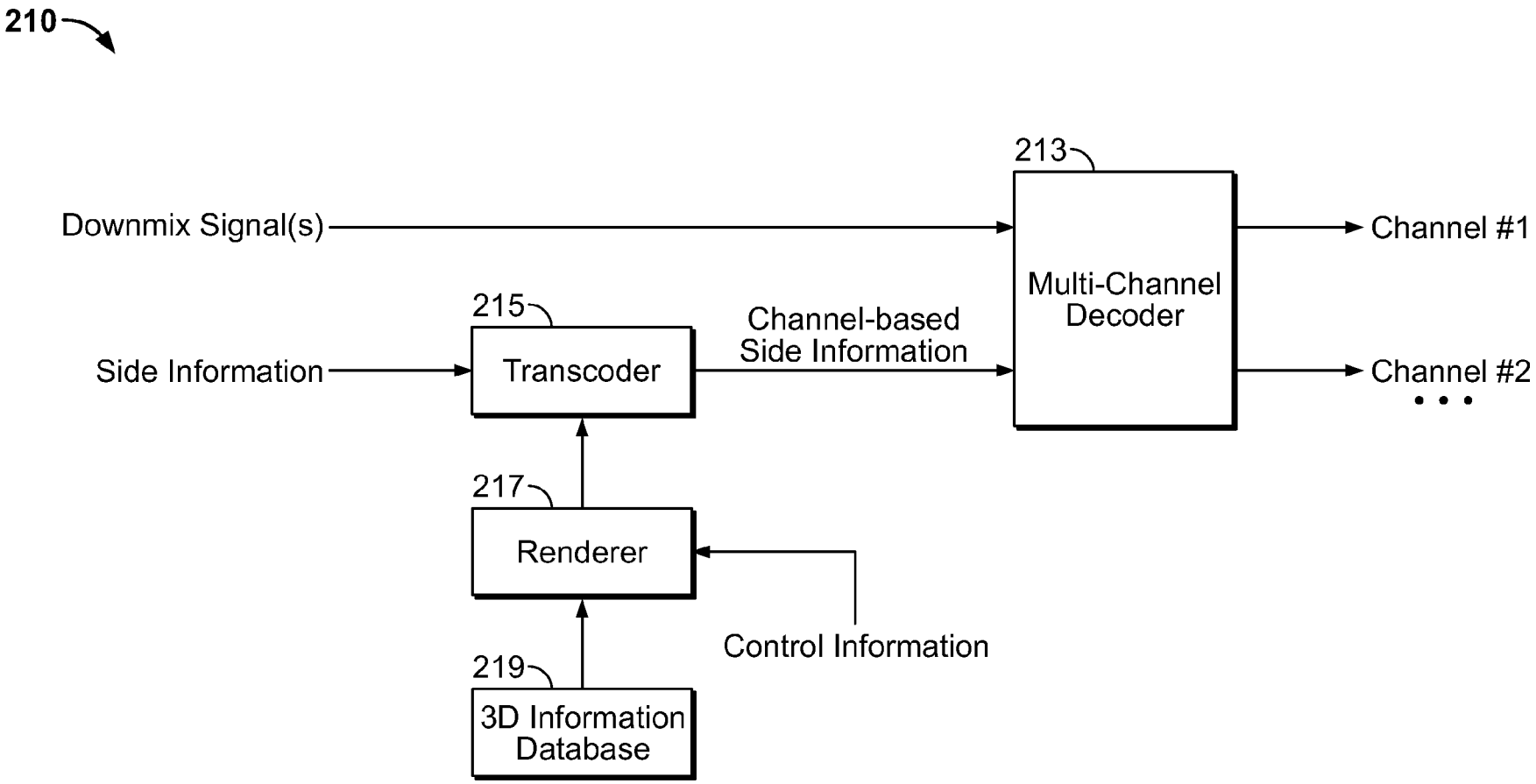
FIG. 12 is a block diagram of an audio decoding apparatus according to a seventh embodiment of the present invention.

FIG. 12 is a block diagram of an audio decoding apparatus 210 according to a seventh embodiment of the present invention. Referring to FIG. 12, the audio decoding apparatus 210 uses a multi-channel decoder 213, instead of an object decoder.

More specifically, the audio decoding apparatus 210 includes the multi-channel decoder 213, a transcoder 215, a renderer 217, and a 3D information database 217.

The renderer 217 determines the 3D positions of a plurality of object signals based on 3D information corresponding to index data included in control information. The transcoder 215 generates channel-based side information by synthesizing position information regarding a number of object audio signals to which 3D information is applied by the renderer 217. The multi-channel decoder 213 outputs a 3D signal by applying the channel-based side information to a down-mix signal A head-related transfer function (HRTF) may be used as the 3D information. An HRTF is a transfer function which describes the transmission of sound waves between a sound source at an arbitrary position and the eardrum, and returns a value that varies according to the direction and altitude of the sound source. If a signal with no directivity is filtered using the HRTF, the signal may be heard as if it were reproduced from a certain direction.

When an input bitstream is received, the audio decoding apparatus 210 extracts an object-based downmix signal and object-based parameter information from the input bitstream using a demultiplexer (not shown). Then, the renderer 217 extracts index data from control information, which is used to determine the positions of a plurality of object audio signals, and withdraws 3D information corresponding to the extracted index data from the 3D information database 219.

More specifically, mixing parameter information, which is included in control information that is used by the audio decoding apparatus 210, may include not only level information but also index data necessary for searching for 3D information. The mixing parameter information may also include time information regarding the time difference between channels, position information and one or more parameters obtained by appropriately combining the level information and the time information.

The position of an object audio signal may be determined initially according to default mixing parameter information, and may be changed later by applying 3D information corresponding to a position desired by a user to the object audio signal. Alternatively, if the user wishes to apply a 3D effect only to several object audio signals, level information and time information regarding other object audio signals to which the user wishes not to apply a 3D effect may be used as mixing parameter information.

The transcoder 217 generates channel-based side information regarding M channels by synthesizing object-based parameter information regarding N object signals transmitted by an audio encoding apparatus and position information of a number of object signals to which 3D information such as an HRTF is applied by the renderer 217.

The multi-channel decoder 213 generates an audio signal based on a downmix signal and the channel-based side information provided by the transcoder 217, and generates a 3D multi-channel signal by performing a 3D rendering operation using 3D information included in the channel-based side information.

Figure 13:
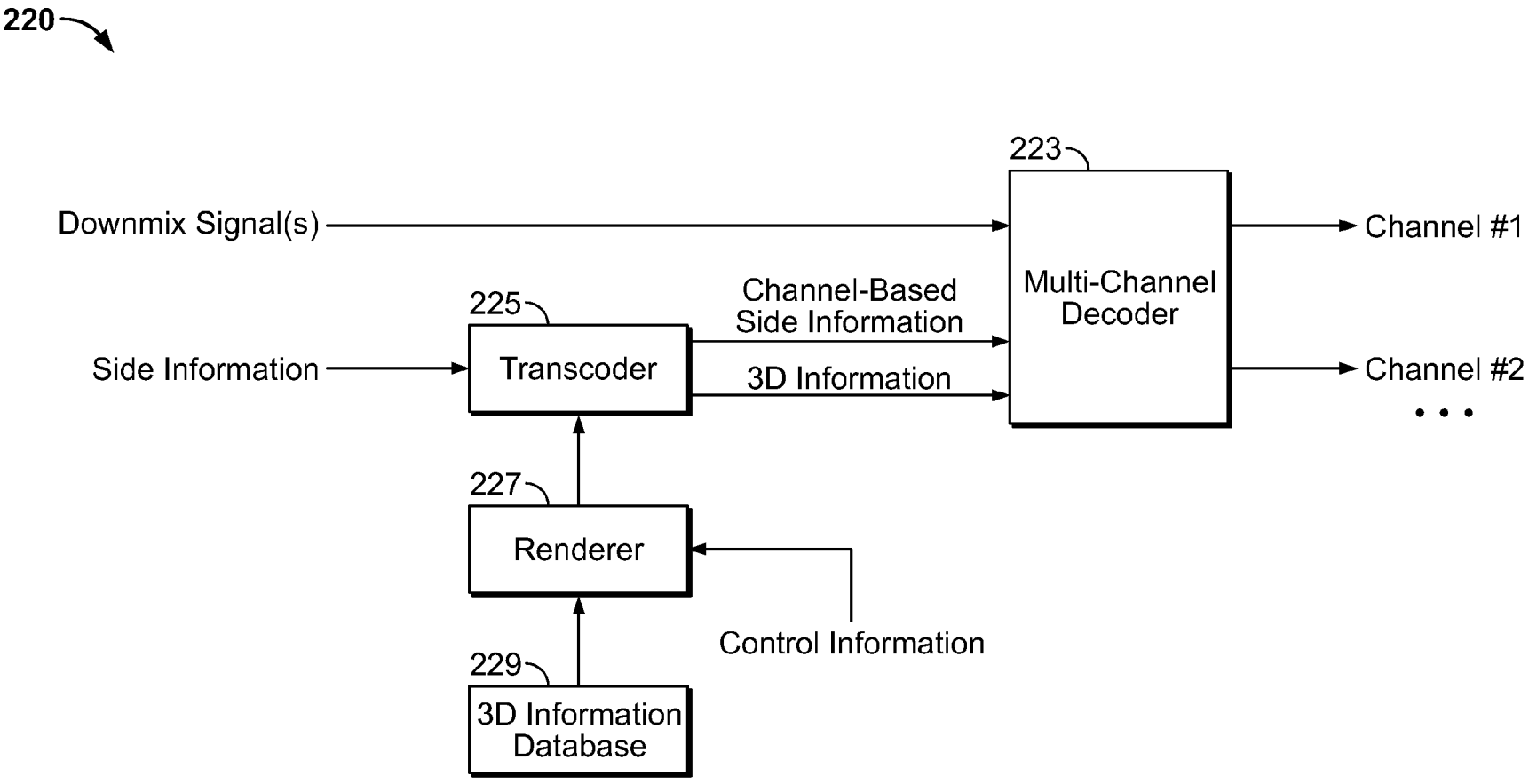
FIG. 13 is a block diagram of an audio decoding apparatus according to an eighth embodiment of the present invention.

FIG. 13 is a block diagram of an audio decoding apparatus 220 according to a eighth embodiment of the present invention. Referring to FIG. 13, the audio decoding apparatus 220 is different from the audio decoding apparatus 210 illustrated in FIG. 12 in that a transcoder 225 transmits channel-based side information and 3D information separately to a multi-channel decoder 223. In other words, the transcoder 225 of the audio decoding apparatus 220 obtains channel-based side information regarding M channels from object-based parameter information regarding N object signals and transmits the channel-based side information and 3D information, which is applied to each of the N object signals, to the multi-channel decoder 223, whereas the transcoder 217 of the audio decoding apparatus 210 transmits channel-based side information including 3D information to the multi-channel decoder 213.

Figure 14:
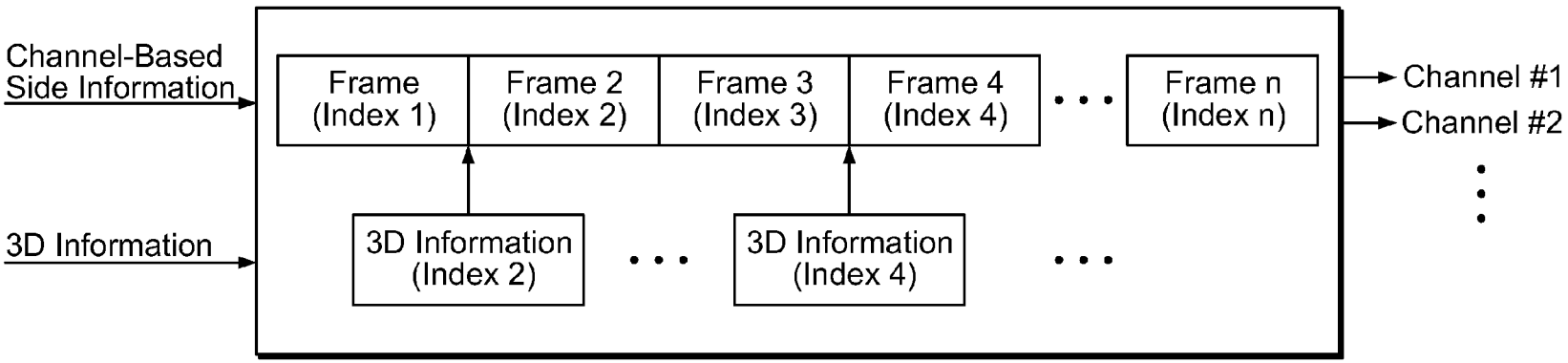
FIG. 14 is a diagram for explaining the application of three-dimensional (3D) information to a frame by the audio decoding apparatus illustrated in FIG. 13.

Referring to FIG. 14, channel-based side information and 3D information may include a plurality of frame indexes. Thus, the multi-channel decoder 223 may synchronize the channel-based side information and the 3D information with reference to the frame indexes of each of the channel-based side information and the 3D information, and may thus apply 3D information to a frame of a bitstream corresponding to the 3D information. For example, 3D information having index 2 may be applied at the beginning of frame 2 having index 2.

Since channel-based side information and 3D information both includes frame indexes, it is possible to effectively determine a temporal position of the channel-based side information to which the 3D information is to be applied, even if the 3D information is updated over time. In other words, the transcoder 225 includes 3D information and a number of frame indexes in channel-based side information, and thus, the multi-channel decoder 223 can easily synchronize the channel-based side information and the 3D information.

The downmix processor 231, transcoder 235, renderer 237 and the 3D information database may be replaced by a single module 239.

Figure 15:
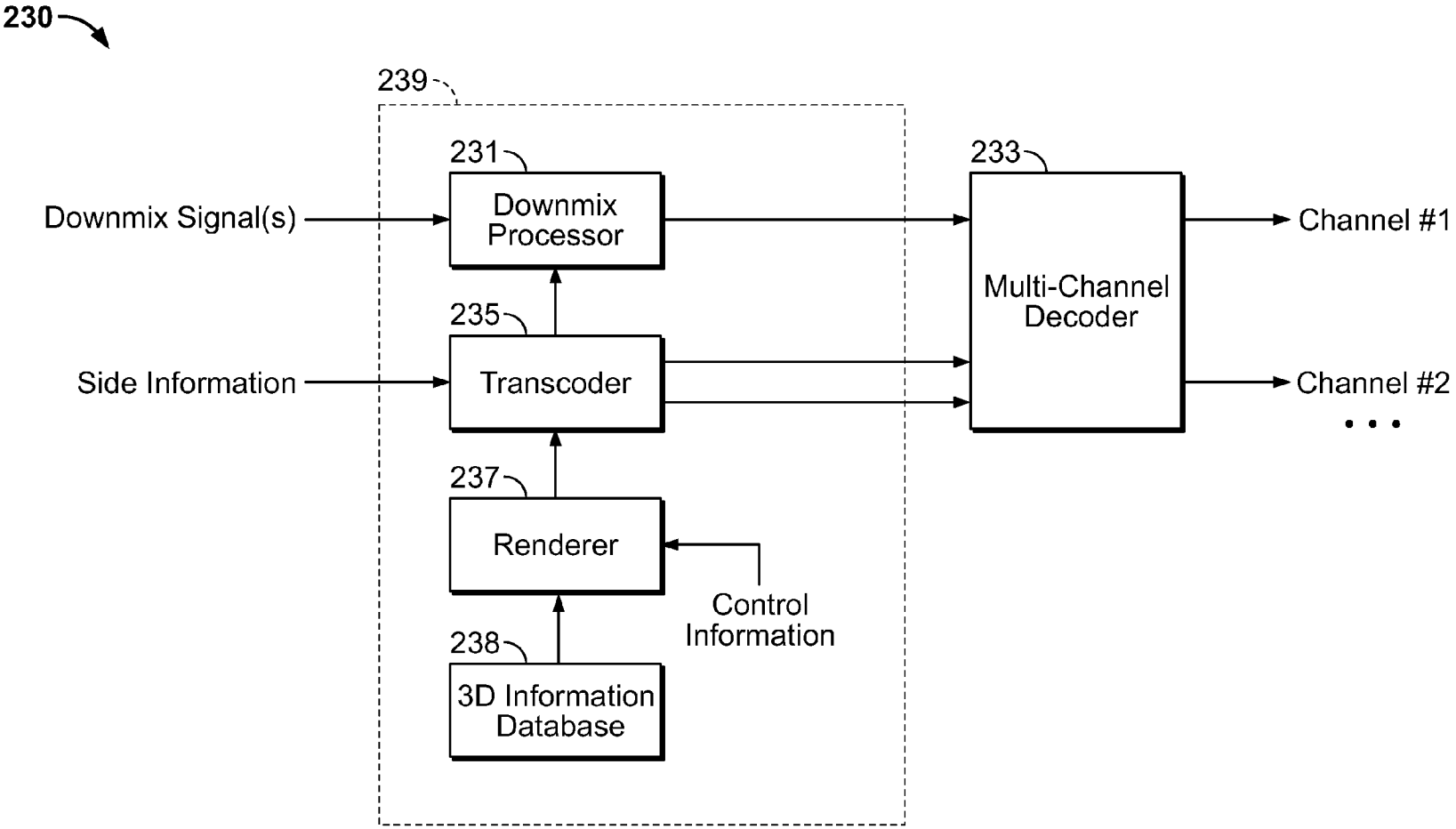
FIG. 15 is a block diagram of an audio decoding apparatus according to a ninth embodiment of the present invention.

FIG. 15 is a block diagram of an audio decoding apparatus 230 according to a ninth embodiment of the present invention. Referring to FIG. 15, the audio decoding apparatus 230 is differentiated from the audio decoding apparatus 220 illustrated in FIG. 14 by further including a downmix processor 231.

More specifically, the audio decoding apparatus 230 includes a transcoder 235, a renderer 237, a 3D information database 239, a multi-channel decoder 233, and the downmix processor 231. The transcoder 235, the renderer 237, the 3D information database 239, and the multi-channel decoder 233 are the same as their respective counterparts illustrated in FIG. 14. The downmix processor 231 performs a pre-processing operation on a stereo downmix signal for position adjustment. The 3D information database 239 may be incorporated with the renderer 237. A module for applying a predetermined effect to a downmix signal may also be provided in the audio decoding apparatus 230.

Figure 16:
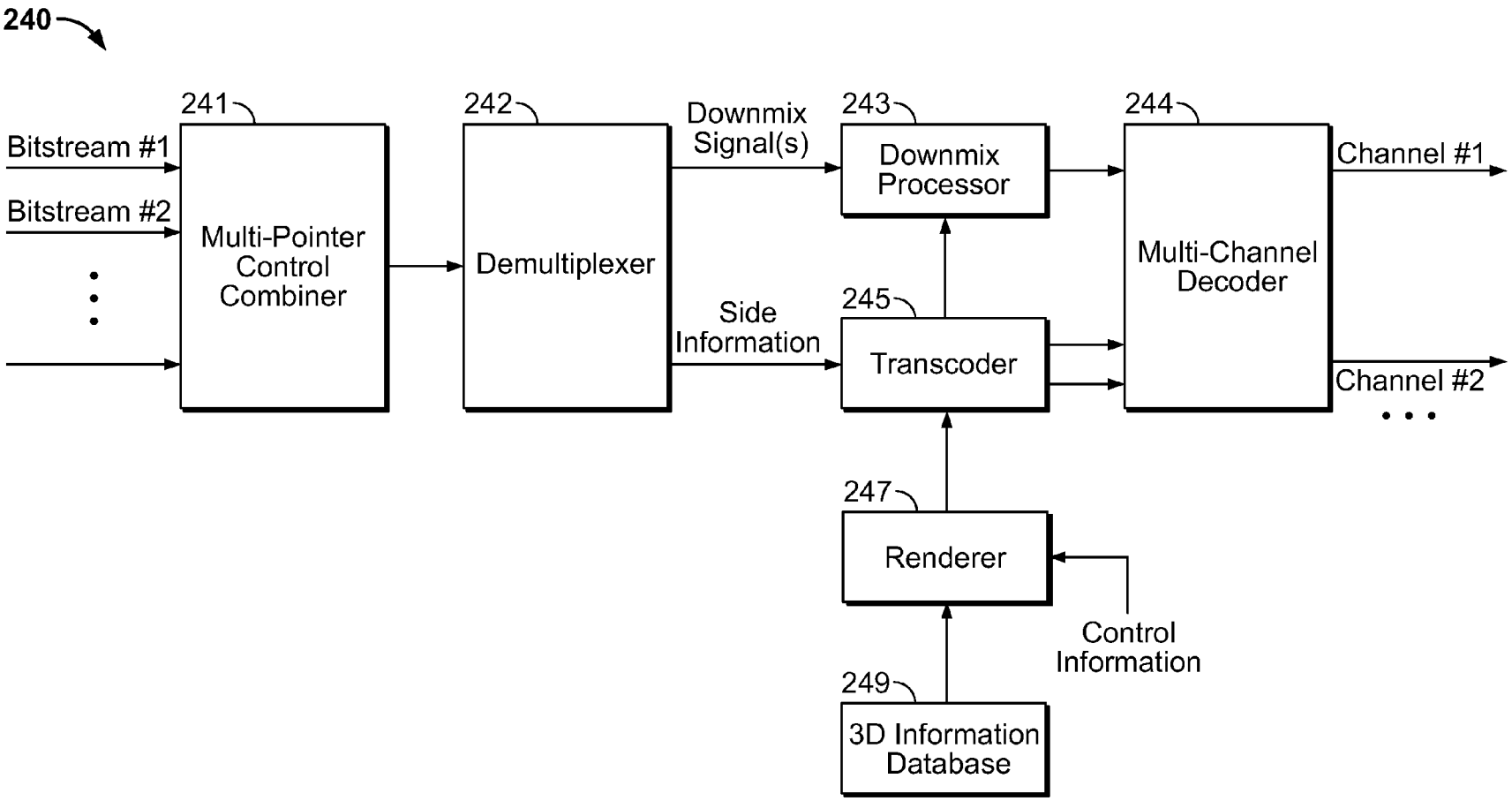
FIG. 16 is a block diagram of an audio decoding apparatus according to a tenth embodiment of the present invention.

FIG. 16 illustrates a block diagram of an audio decoding apparatus 240 according to a tenth embodiment of the present invention. Referring to FIG. 16, the audio decoding apparatus 240 is differentiated from the audio decoding apparatus 230 illustrated in FIG. 15 by including a multi-point control unit combiner 241.

That is, the audio decoding apparatus 240, like the audio decoding apparatus 230, includes a downmix processor 243, a multi-channel decoder 244, a transcoder 245, a renderer 247, and a 3D information database 249. The multi-point control unit combiner 241 combines a plurality of bitstreams obtained by object-based encoding, thereby obtaining a single bitstream. For example, when a first bitstream for a first audio signal and a second bitstream for a second audio signal are input, the multi-point control unit combiner 241 extracts a first downmix signal from the first bitstream, extracts a second downmix signal from the second bitstream and generates a third downmix signal by combining the first and second downmix signals. In addition, the multi-point control unit combiner 241 extracts first object-based side information from the first bitstream, extract second object-based side information from the second bitstream, and generates third object-based side information by combining the first object-based side information and the second object-based side information. Thereafter, the multi-point control unit combiner 241 generates a bitstream by combining the third downmix signal and the third object-based side information and outputs the generated bitstream.

Therefore, according to the tenth embodiment of the present invention, it is possible to efficiently process even signals transmitted by two or more communication partners compared to the case of encoding or decoding each object signal.

In order for the multi-point control unit combiner 241 to incorporate a plurality of downmix signals, which are respectively extracted from a plurality of bitstreams and are associated with different compression codecs, into a single downmix signal, the downmix signals may need to be converted into pulse code modulation (PCM) signals or signals in a predetermined frequency domain according to the types of the compression codecs of the downmix signals, the PCM signals or the signals obtained by the conversion may need to be combined together, and a signal obtained by the combination may need to be converted using a predetermined compression codec. In this case, a delay may occur according to whether the downmix signals are incorporated into a PCM signal or into a signal in the predetermined frequency domain. The delay, however, may not be able to be properly estimated by a decoder. Therefore, the delay may need to be included in a bitstream and transmitted along with the bitstream. The delay may indicate the number of delay samples in a PCM signal or the number of delay samples in the predetermined frequency domain.

During an object-based audio coding operation, a considerable number of input signals may sometimes need to be processed compared to the number of input signals generally processed during a typical multi-channel coding operation (e.g., a 5.1-channel or 7.1-channel coding operation). Therefore, an object-based audio coding method requires much higher bitrates than a typical channel-based multi-channel audio coding method. However, since an object-based audio coding method involves the processing of object signals which are smaller than channel signals, it is possible to generate dynamic output signals using an object-based audio coding method.

An audio encoding method according to an embodiment of the present invention will hereinafter be described in detail with reference to FIGS. 17 through 20.

In an object-based audio encoding method, object signals may be defined to represent individual sounds such as the voice of a human or the sound of a musical instrument. Alternatively, sounds having similar characteristics such as the sounds of stringed musical instruments (e.g., a violin, a viola, and a cello), sounds belonging to the same frequency band, or sounds classified into the same category according to the directions and angles of their sound sources, may be grouped together, and defined by the same object signals. Still alternatively, object signals may be defined using the combination of the above-described methods.

A number of object signals may be transmitted as a downmix signal and side information. During the creation of information to be transmitted, the energy or power of a downmix signal or each of a plurality of object signals of the downmix signal is calculated originally for the purpose of detecting the envelope of the downmix signal. The results of the calculation may be used to transmit the object signals or the downmix signal or to calculate the ratio of the levels of the object signals.

A linear predictive coding (LPC) algorithm may be used to lower bitrates. More specifically, a number of LPC coefficients which represent the envelope of a signal are generated through the analysis of the signal, and the LPC coefficients are transmitted, instead of transmitting envelop information regarding the signal. This method is efficient in terms of bitrates. However, since the LPC coefficients are very likely to be discrepant from the actual envelope of the signal, this method requires an addition process such as error correction. In short, a method that involves transmitting envelop information of a signal can guarantee a high quality of sound, but results in a considerable increase in the amount of information that needs to be transmitted. On the other hand, a method that involves the use of LPC coefficients can reduce the amount of information that needs to be transmitted, but requires an additional process such as error correction and results in a decrease in the quality of sound.

According to an embodiment of the present invention, a combination of these methods may be used. In other words, the envelope of a signal may be represented by the energy or power of the signal or an index value or another value such as an LPC coefficient corresponding to the energy or power of the signal.

Envelope information regarding a signal may be obtained in units of temporal sections or frequency sections. More specifically, referring to FIG. 17, envelope information regarding a signal may be obtained in units of frames. Alternatively, if a signal is represented by a frequency band structure using a filter bank such as a quadrature mirror filter (QMF) bank, envelope information regarding a signal may be obtained in units of frequency sub-bands, frequency sub-band partitions which are smaller entities than frequency sub-bands, groups of frequency sub-bands or groups of frequency sub-band partitions. Still alternatively, a combination of the frame-based method, the frequency sub-band-based method, and the frequency sub-band partition-based method may be used within the scope of the present invention.

Still alternatively, given that low-frequency components of a signal generally have more information than high-frequency components of the signal, envelop information regarding low-frequency components of a signal may be transmitted as it is, whereas envelop information regarding high-frequency components of the signal may be represented by LPC coefficients or other values and the LPC coefficients or the other values may be transmitted instead of the envelop information regarding the high-frequency components of the signal. However, low-frequency components of a signal may not necessarily have more information than high-frequency components of the signal. Therefore, the above-described method must be flexibly applied according to the circumstances.

According to an embodiment of the present invention, envelope information or index data corresponding to a portion (hereinafter referred to as the dominant portion) of a signal that appears dominant on a time/frequency axis may be transmitted, and none of envelope information and index data corresponding to a non-dominant portion of the signal may be transmitted. Alternatively, values (e.g., LPC coefficients) that represent the energy and power of the dominant portion of the signal may be transmitted, and no such values corresponding to the non-dominant portion of the signal may be transmitted. Still alternatively, envelope information or index data corresponding to the dominant portion of the signal may be transmitted, and values that represent the energy or power of the non-dominant portion of the signal may be transmitted. Still alternatively, information only regarding the dominant portion of the signal may be transmitted so that the non-dominant portion of the signal can be estimated based on the information regarding the dominant portion of the signal. Still alternatively, a combination of the above-described methods may be used.

Figure 18:
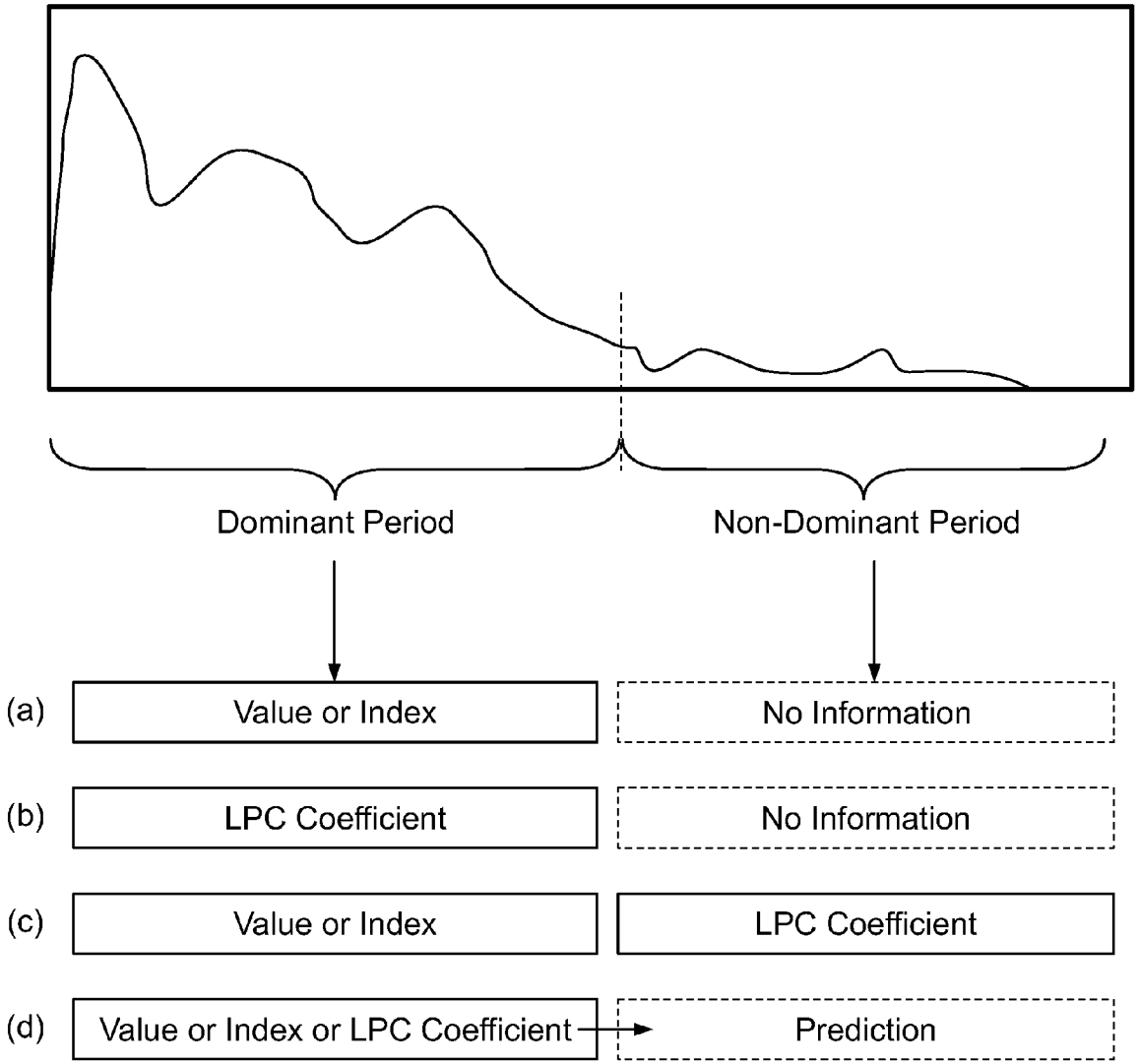
FIGS. 17 through 19 are diagrams for explaining an audio decoding method according to an embodiment of the present invention.
Figure 17:
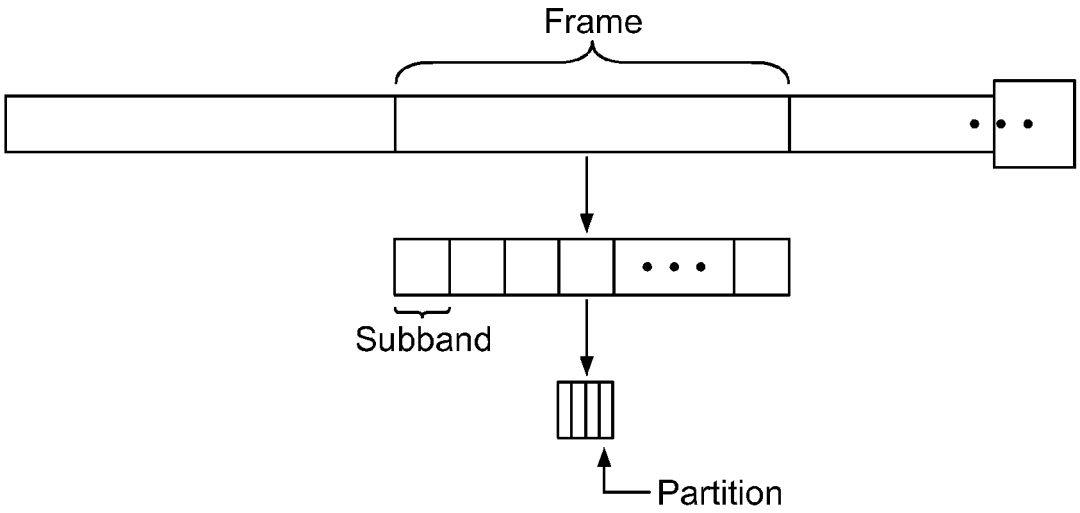

For example, referring to FIG. 18, if a signal is divided into a dominant period and a non-dominant period, information regarding the signal may be transmitted in four different manners, as indicated by (a) through (d).

In order to transmit a number of object signals as the combination of a downmix signal and side information, the downmix signal needs to be divided into a plurality of elements as part of a decoding operation, for example, in consideration of the ratio of the levels of the object signals. In order to guarantee independence between the elements of the downmix signal, a decorrelation operation needs to be additionally performed.

Object signals which are the units of coding in an object-based coding method have more independence than channel signals which are the units of coding in a multi-channel coding method. In other words, a channel signal includes a number of object signals, and thus needs to be decorrelated. On the other hand, object signals are independent from one another, and thus, channel separation may be easily performed simply using the characteristics of the object signals without a requirement of a decorrelation operation.

Figure 19:
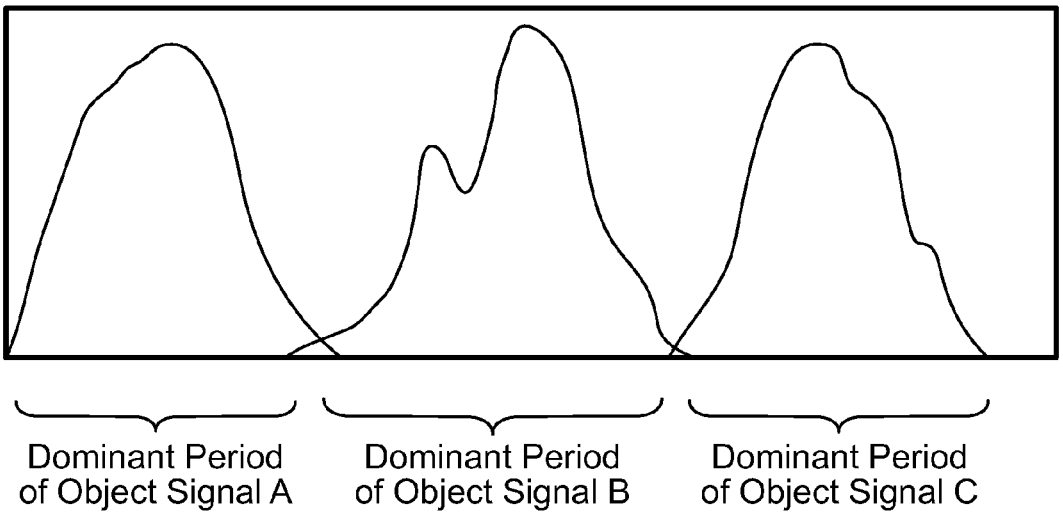

More specifically, referring to FIG. 19, object signals A, B, and C take turns to appear dominant on a frequency axis. In this case, there is no need to divide a downmix signal into a number of signals according to the ratio of the levels of the object signals A, B, and C and to perform decorrelation. Instead, information regarding the dominant periods of the object signals A, B, and C may be transmitted, or a gain value may be applied to each frequency component of each of the object signals A, B, and C, thereby skipping decorrelation. Therefore, it is possible to reduce the amount of computation and to reduce the bitrate by the amount that would have otherwise been required by side information necessary for decorrelation.

In short, in order to skip decorrelation, which is performed so as to guarantee independence among a number of signals obtained by dividing a downmix signal according to the ratio of the ratios of object signals of the downmix signal, information regarding a frequency domain including each object signal may be transmitted as side information. Alternatively, different gain values may be applied to a dominant period during which each object signal appears dominant and a non-dominant period during which each object signal appears less dominant, and thus, information regarding the dominant period may be mainly provided as side information. Still alternatively, the information regarding the dominant period may be transmitted as side information, and no information regarding the non-dominant period may be transmitted. Still alternatively, a combination of the above-described methods which are alternatives to a decorrelation method may be used.

The above-described methods which are alternatives to a decorrelation method may be applied to all object signals or only to some object signals with easily distinguishable dominant periods. Also, the above-described methods which are alternatives to a decorrelation method may be variably applied in units of frames.

The encoding of object audio signals using a residual signal will hereinafter be described in detail.

In general, in an object-based audio coding method, a number of object signals are encoded, and the results of the encoding are transmitted as the combination of a downmix signal and side information. Then, a number of object signals are restored from the downmix signal through decoding according to the side information, and the restored object signals are appropriately mixed, for example, at the request of a user according to control information, thereby generating a final channel signal. An object-based audio coding method generally aims to freely vary an output channel signal according to control information with the aid of a mixer. However, an object-based audio coding method may also be used to generate a channel output in a predefined manner regardless of control information.

For this, side information may include not only information necessary to obtain a number of object signals from a downmix signal but also mixing parameter information necessary to generate a channel signal. Thus, it is possible to generate a final channel output signal without the aid of a mixer. In this case, such an algorithm as residual coding may be used to improve the quality of sound.

A typical residual coding method includes coding a signal and coding the error between the coded signal and the original signal, i.e., a residual signal. During a decoding operation, the coded signal is decoded while compensating for the error between the coded signal and the original signal, thereby restoring a signal that is as similar to the original signal as possible. Since the error between the coded signal and the original signal is generally inconsiderable, it is possible to reduce the amount of information additionally necessary to perform residual coding.

If a final channel output of a decoder is fixed, not only mixing parameter information necessary for generating a final channel signal but also residual coding information may be provided as side information. In this case, it is possible to improve the quality of sound.

Figure 20:
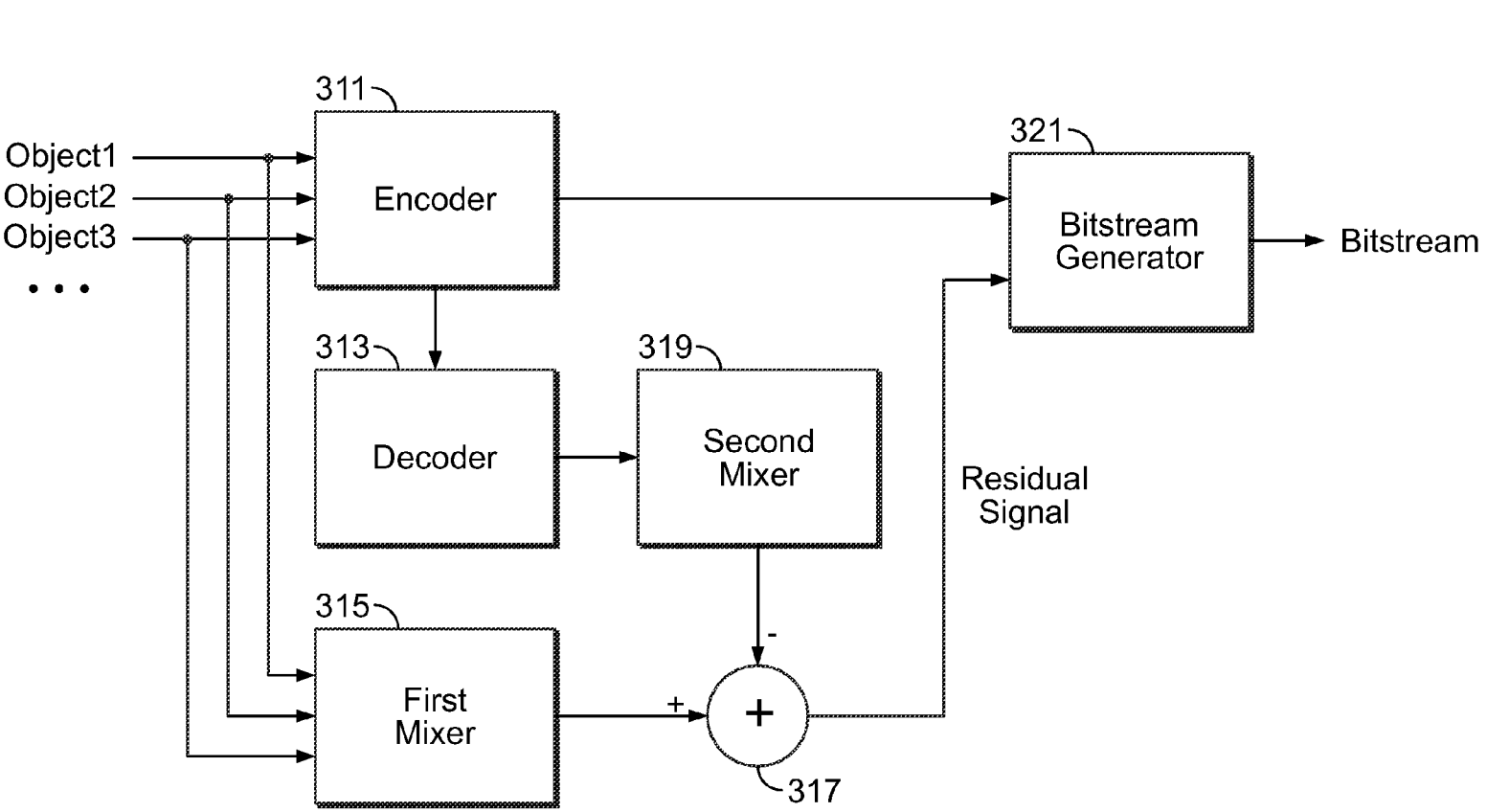
FIG. 20 is a block diagram of an audio encoding apparatus according to an embodiment of the present invention.

FIG. 20 is a block diagram of an audio encoding apparatus 310 according to an embodiment of the present invention. Referring to FIG. 20, the audio encoding apparatus 310 is characterized by using a residual signal.

More specifically, the audio encoding apparatus 310 includes an encoder 311, a decoder 313, a first mixer 315, a second mixer 319, an adder 317 and a bitstream generator 321.

The first mixer 315 performs a mixing operation on an original signal, and the second mixer 319 performs a mixing operation on a signal obtained by performing an encoding operation and then a decoding operation on the original signal. The adder 317 calculates a residual signal between a signal output by the first mixer 315 and a signal output by the second mixer 319. The bitstream generator 321 adds the residual signal to side information and transmits the result of the addition. In this manner, it is possible to enhance the quality of sound.

The calculation of a residual signal may be applied to all portions of a signal or only for low-frequency portions of a signal. Alternatively, the calculation of a residual signal may be variably applied only to frequency domains including dominant signals on a frame-by-frame basis. Still alternatively, a combination of the above-described methods may be used.

Since the amount of side information including residual signal information is much greater than the amount of side information including no residual signal information, the calculation of a residual signal may be applied only to some portions of a signal that directly affect the quality of sound, thereby preventing an excessive increase in bitrate.

The present invention can be realized as computer-readable code written on a computer-readable recording medium. The computer-readable recording medium may be any type of recording device in which data is stored in a computer-readable manner. Examples of the computer-readable recording medium include a ROM, a RAM, a CD-ROM, a magnetic tape, a floppy disc, an optical data storage, and a carrier wave (e.g., data transmission through the Internet). The computer-readable recording medium can be distributed over a plurality of computer systems connected to a network so that computer-readable code is written thereto and executed therefrom in a decentralized manner. Functional programs, code, and code segments needed for realizing the present invention can be easily construed by one of ordinary skill in the art.

As described above, according to the present invention, sound images are localized for each object audio signal by benefiting from the advantages of object-based audio encoding and decoding methods. Thus, it is possible to offer more realistic sounds through the reproduction of object audio signals. In addition, the present invention may be applied to interactive games, and may thus provide a user with a more realistic virtual reality experience.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An audio decoding method comprising:

receiving, by an audio decoding apparatus, a downmix signal comprising at least one object signal, and object-based side information generated when the at least one object signal is downmixed into the downmix signal, wherein the downmix signal is a stereo signal consisting of a left channel signal and a right channel signal;

receiving, by an audio decoding apparatus, control information for controlling position or level of at least one object signal;

generating, by an audio decoding apparatus, channel-based side information based on the object-based side information and the control information;

generating, by an audio decoding apparatus, parameter information using the object-based side information and the control information;

generating, by an audio decoding apparatus, a processed downmix signal by modifying the downmix signal using the parameter information wherein a position or level of at least one object signal is controlled based at least in part on the control information, and wherein the processed downmix signal is a stereo signal consisting of a left channel signal and a right channel signal; and generating, by an audio decoding apparatus, a multi-channel audio signal using the processed downmix signal and the channel-based side information wherein:

the downmix signal is modified in a frequency domain, a number of channels of the processed downmix signal is equal to a number of channels of the downmix signal, a number of channels of the multi-channel audio signal is larger than the number of channels of the processed downmix signal, and the channel-based side information is used to generate a multi-channel signal from a mono signal or a stereo signal.

2. The audio decoding method of claim 1, wherein the downmix signal is modified by performing at least one of level adjustment, sound image processing and effect addition on the downmix signal.

3. The audio decoding method of claim 1, wherein the processed downmix signal is generated using a decorrelated channel signal.

4. The method of claim 1, where in the audio decoding apparatus processes a plurality of object signals as a single sound source according to the position or level specified in the control information.

5. The audio decoding method of claim 1, wherein the object-based side information comprises at least one of object level difference information, inter object cross correlation information, downmix gain information, downmix channel level difference information, and absolute object energy information.

6. The audio decoding method of claim 1, wherein the channel-based side information comprises at least one of channel level differences information, inter-channel correlation information, and channel prediction coefficient information.

7. An audio decoding apparatus comprising:

a demultiplexer receiving a downmix signal comprising at least one object signal, and object-based side information generated when the at least one object signal is downmixed into the downmix signal, wherein the downmix signal is a stereo signal consisting of a left channel signal and a right channel signal;

a parameter converter configured to:

receive control information for controlling position or level of at least one object signal, generate parameter information using the object based side information and the control information, and, generate channel-based side information based on the object-based side information and the control information;

a downmix processor generating a processed downmix signal by modifying the downmix signal using the parameter information wherein a position or level of at least one object signal is controlled based at least in part on the control information, and wherein the processed downmix signal is a stereo signal consisting of a left channel signal and a right channel signal; and a multi-channel decoder generating a multi-channel audio signal using the processed downmix signal and the channel-based side information, wherein:

the downmix signal is modified in a frequency domain, a number of channels of the processed downmix signal is equal to a number of channels of the downmix signal, a number of channels of the multi-channel audio signal is larger than the number of channels of the processed downmix signal, and the channel-based side information is used to generate a multi-channel signal from a mono signal or a stereo signal.

8. The audio decoding apparatus of claim 7, wherein the downmix signal is modified by performing at least one of level adjustment, sound image processing and effect addition on the downmix signal.

9. The audio decoding apparatus of claim 7, wherein the processed downmix signal is generated using a decorrelated channel signal.

10. The audio decoding apparatus of claim 7, where in the audio decoding apparatus processes a plurality of object signals as a single sound source according to the position or level specified in the control information.

* * * * *

UNITED STATES PATENT AND TRADEMARK OFFICE

CERTIFICATE OF CORRECTION

PATENT NO. : 8,625,808 B2
APPLICATION NO. : 11/865632
DATED : January 7, 2014
INVENTOR(S) : Kim et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1350 days.

Signed and Sealed this
Nineteenth Day of May, 2015

Michelle K. Lee

Michelle K. Lee
*Director of the United States Patent and Trademark Office*